US008603719B2

(12) United States Patent
Yamashita et al.

(10) Patent No.: US 8,603,719 B2
(45) Date of Patent: Dec. 10, 2013

(54) METHOD FOR PRODUCING ELECTROPHOTOGRAPHIC TONER, ELECTROPHOTOGRAPHIC TONER, FULL-COLOR IMAGE FORMING METHOD AND FULL-COLOR IMAGE FORMING APPARATUS

(75) Inventors: Hiroshi Yamashita, Shizuoka (JP); Yuichi Shirasu, Shizuoka (JP); Masaki Watanabe, Shizuoka (JP); Tomoki Murayama, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 168 days.

(21) Appl. No.: 13/163,958

(22) Filed: Jun. 20, 2011

(65) Prior Publication Data

US 2011/0318053 A1 Dec. 29, 2011

(30) Foreign Application Priority Data

Jun. 25, 2010 (JP) ..... 2010-144450

(51) Int. Cl.
*G03G 9/08* (2006.01)

(52) U.S. Cl.
USPC ..... 430/137.1; 430/137.11; 430/137.14; 430/137.15

(58) Field of Classification Search
USPC ..... 430/137.1, 137.11, 137.14, 137.15
See application file for complete search history.

(56) References Cited

U.S. PATENT DOCUMENTS

| | | | | |
|---|---|---|---|---|
| 2005/0074685 | A1* | 4/2005 | Kido et al. | 430/110.2 |
| 2007/0134583 | A1* | 6/2007 | Cheong et al. | 430/109.3 |
| 2010/0081075 | A1* | 4/2010 | Watanabe et al. | 430/108.21 |
| 2010/0310980 | A1 | 12/2010 | Sugimoto et al. | |
| 2011/0076612 | A1 | 3/2011 | Awamura et al. | |

FOREIGN PATENT DOCUMENTS

| | | |
|---|---|---|
| JP | 11-7156 A | 1/1999 |
| JP | 4136668 | 6/2008 |
| JP | 4284005 | 3/2009 |
| JP | 2011-33823 | 2/2011 |

OTHER PUBLICATIONS

Office Action issued Apr. 27, 2012, in Chinese Patent application No. 201110174517.9 (with English-language translation).

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A method for producing an electrophotographic toner including forming a toner base particle by emulsifying or dispersing a solution or dispersion of a toner material comprising a colorant, and any one of a binder resin and a binder resin precursor in an aqueous medium, and adding crystalline organic fine particles having an acid value of 20 mgKOH/g to 80 mgKOH/g into the aqueous medium, before, during or after the forming so as to attach the crystalline organic fine particles onto a surface of the toner base particle.

12 Claims, 8 Drawing Sheets

FIG. 2A
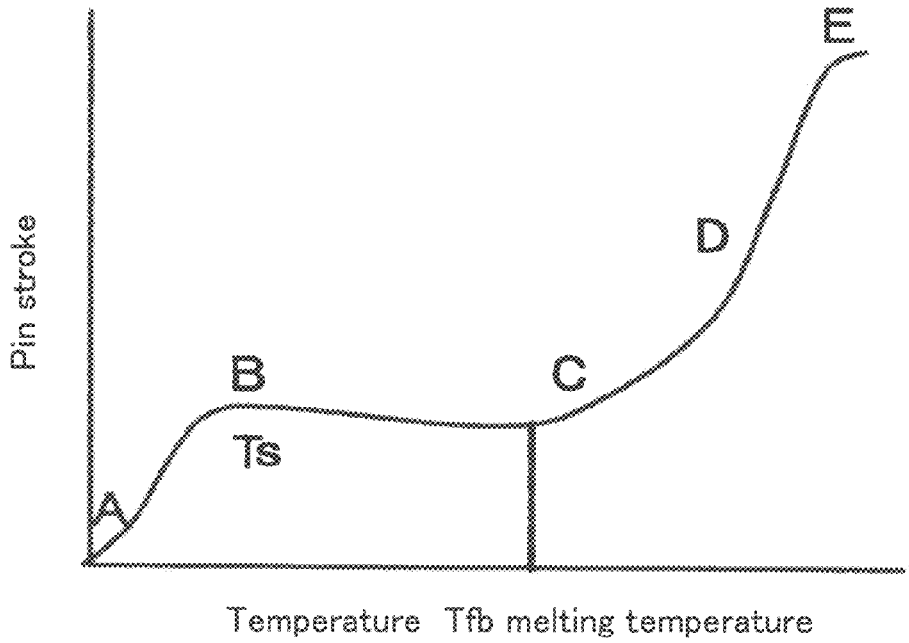
FIG. 2B
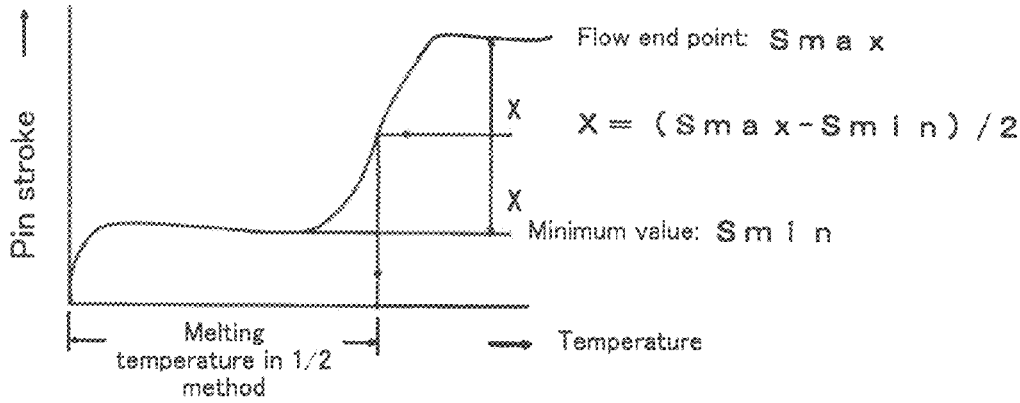
FIG. 3

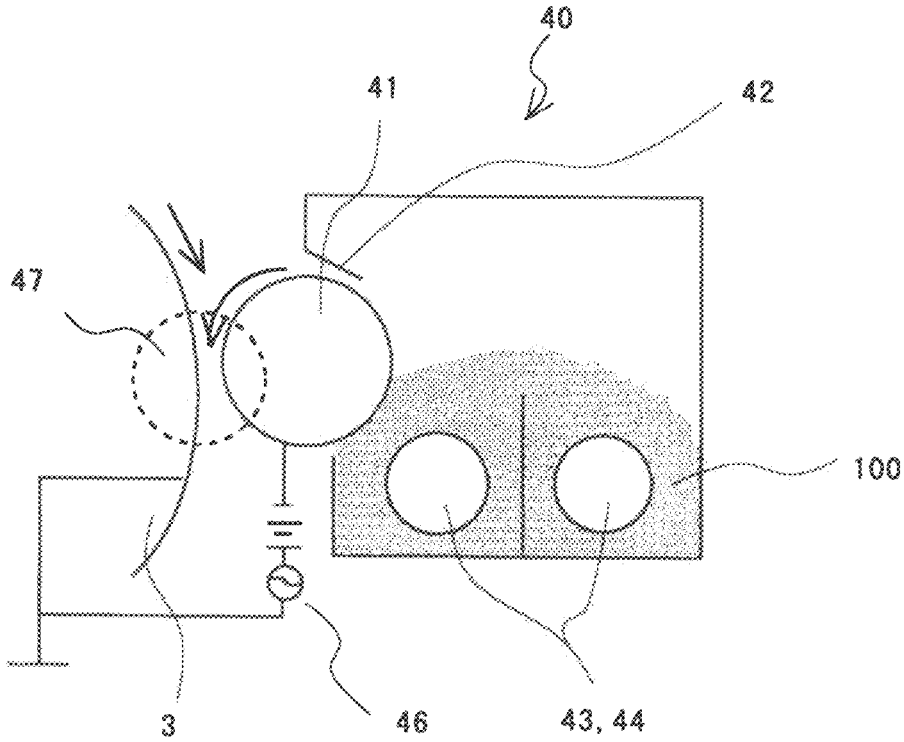
FIG. 6
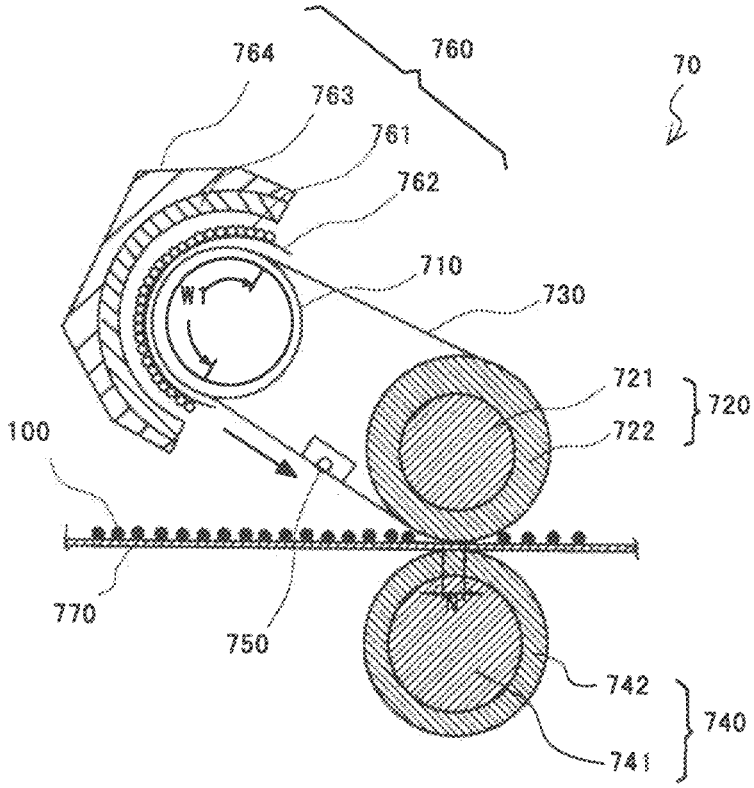

METHOD FOR PRODUCING ELECTROPHOTOGRAPHIC TONER, ELECTROPHOTOGRAPHIC TONER, FULL-COLOR IMAGE FORMING METHOD AND FULL-COLOR IMAGE FORMING APPARATUS

BACKGROUND OF THE INVENTION

1. Field of the Invention

The present invention relates to a method for producing an electrophotographic toner, an electrophotographic toner, a full-color image forming method, and a full-color image forming apparatus.

2. Description of the Related Art

In recent years, in the field of an image forming technology utilizing electrophotography, there is an ever-increasing competition in the development of an apparatus for color image formation that can realize high-speed image formation and, at the same time, can yield a color image having high image quality (technology for forming high grade color image). For this reason, in order to form a full color image at a high speed, the so-called tandem system has become extensively adopted in methods for image formation. In the tandem system, a plurality of electrophotographic photoconductors (otherwise referred to as photoconductor or photoconductors, simply) are tandemly arranged. Images for respective color components are formed in respective electrophotographic photoconductors. The formed images are superimposed on top of each other on an intermediate transfer medium, and the superimposed images are transferred at a time on a recording medium (for example, Japanese Patent Application Laid-Open (JP-A) Nos. 07-209952 and 2000-075551).

The use of the intermediate transfer medium is effective in preventing the transfer of smear directly onto a recording medium such as paper when smear has occurred on the electrophotographic photoconductors during development. Since, however, in the system using the intermediate transfer medium, two transfer steps, that is, a step of transfer from the electrophotographic photoconductor to the intermediate transfer medium (primary transfer) and a step of transfer from the intermediate transfer medium to a recording medium to give a final image (secondary transfer), are performed, the transfer efficiency is lowered.

On the other hand, in addition to the above problem, there is a demand for the formation of a high-quality full color image. To meet this demand, a developer has been designed for improving an image quality. In order to cope with the demand for the improved image quality, particularly in a full color image, there is an increasing tendency toward the production of a toner having a smaller particle diameter, and studies have been made on faithful reproduction of a latent image to be formed on a photoconductor. Regarding the reduction in particle diameter, a process for producing a toner by a polymerization process has been proposed as a method that can regulate the toner so as to have a desired shape and surface structure (for example, Japanese Patent No. (JP-B) 3640918, and Japanese Patent Application Laid-Open (JP-A) No. 06-250439). In the toner produced by the polymerization process, in addition to the control of the diameter of toner particles, the shape of toner particles can also be controlled. A combination of this technique with a particle size reduction can improve the reproducibility of dots and narrow lines, and can reduce pile height (image layer thickness), whereby an improvement in image quality can be expected.

When a toner having a small particle diameter is used, however, non-electrostatic adhesion between the toner particle and the electrophotographic photoconductor or between the toner particle and the intermediate transfer medium is increased. Accordingly, the transfer efficiency is likely to be further lowered. This leads to such an unfavorable phenomenon that, when the toner having a small particle diameter is used in a high-speed full-color image forming apparatus, the transfer efficiency, particularly in the secondary transfer is significantly lowered. The reason for this is that the degree of difficulty of transfer is increased because, due to the reduction in particle diameter of the toner, the non-electrostatic adhesion to the intermediate transfer medium per toner particle is increased, a plurality of color toners are present in a superimposed state in the secondary transfer, and, due to an increase in speed, the period of time, for which the toner particle undergoes a transfer electric field in a nip portion in the secondary transfer, is decreased.

Further increasing the transfer electric field in the secondary transfer is considered effective in overcoming the above problem. However, when the transfer electric field is excessively increased, the transfer efficiency disadvantageously decreases. Accordingly, there is a limitation on this technique.

Prolonging the period of time for which the toner particle undergoes the transfer electric field by increasing the width of the nip portion in the secondary transfer is also considered. In a contact-type voltage application system using a bias roller and the like, in order to increase the nip width, only any one of a method in which the contact pressure of the bias roller is increased, and a method in which the roller diameter of the bias roller is increased, can be adopted. Increasing the contact pressure has a limitation from the viewpoints of image quality, and increasing the roller diameter has a limitation from the viewpoint of a reduction in size of the apparatus. In a non-contact-type voltage application system using a charger or the like, the nip width in the secondary transfer should be increased, for example, by increasing the number of chargers. Accordingly, this also has a limitation. For the above reason, it can be said that, particularly in high-speed machines, it is practically impossible to increase the nip width so as to obtain transfer efficiency higher than that in the present stage.

On the other hand, a method has been proposed in which the type and addition amount of additives are regulated (particularly, additives having a large particle diameter is added) as a method that reduces the non-electrostatic adhesion between a toner particle and an electrophotographic photoconductor or between the toner particle and an intermediate transfer medium (for example, JP-A No. 2001-066820 and JP-B No. 3692829). According to this method, by virtue of the non-electrostatic adhesion reduction effect, the toner particle can realize improvement in transfer efficiency. Further, in this method, additional effects such as stability of development and improvement in cleaning effect can be attained.

SUMMARY OF THE INVENTION

The above-described toner particle can improve the transfer efficiency of the image forming apparatus at an early stage. However, when the toner continues to receive mechanical stress, for example, is subjected to long-term stirring in a developing unit in the image forming apparatus, the additive is embedded in toner base particles. As a result, the additive cannot exhibit the adhesion reduction effect, and thus, the transfer efficiency of the image forming apparatus may decrease.

Particularly in the case of high speed devices, toner particles are intensively stirred in a developing device to receive large mechanical stress. This accelerates embedding of the additive in the toner base particles. Thus, it is estimated that the transfer efficiency decreases at a relatively early stage.

In order to solve these problems, the inventors of the present invention have proposed to provide a layer of organic fine particles in a toner surface.

However, the organic fine particles adhere to the surface of the toner base particle so as to form a coating layer. However, it has been revealed that the adhesion of the organic fine particles to a binder resin contained in the toner is poor, and the coating layer of the organic fine particles is partly separated with ease by mechanical impact or friction.

Therefore, in order to maintain stable, high transfer efficiency for a long term in the high speed devices, it is necessary to control the adhesion of the organic fine particles to the toner, and fusion properties with the binder resin, so that a layer of the organic fine particles can be present in the toner surface without separating from the toner surface, even though the toner surface receives mechanical stress. Moreover, it is necessary to pay attention to adverse effect that fixing ability of the toner is degraded, since the toner is formed to have excessively hard surface to obtain strong mechanical strength, melting of the toner is inhibited upon fixation of the toner, and in the case where the toner contains a releasing agent such as wax, the releasing agent does not sufficiently ooze out to a fixation roller upon fixation of the toner.

When the adhesion between the organic fine particles and paper, or the adhesion of toners is not sufficient, a large amount of energy is required for fixation.

The present invention aims to provide a method for producing an electrophotographic toner, which can improve transfer efficiency, cause no image defect upon transferring and output images with excellent reproducibility for a long period of time, and improve fixing ability in high-speed full-color image formation, the electrophotographic toner, a full-color image forming method, and a full-color image forming apparatus.

Means for solving problems are as follows.

<1> A method for producing an electrophotographic toner containing: forming a toner base particle by emulsifying or dispersing a solution or dispersion of a toner material containing a colorant, and any one of a binder resin and a binder resin precursor in an aqueous medium; and adding crystalline organic fine particles having an acid value of 20 mgKOH/g to 80 mgKOH/g into the aqueous medium, before, during or after the forming so as to attach the crystalline organic fine particles onto a surface of the toner base particle.

<2> The method for producing an electrophotographic toner according to <1>, wherein the crystalline organic fine particles are crystalline polyester resin fine particles obtained from aliphatic diol as a monomer component.

<3> The method for producing an electrophotographic toner according to <1>, wherein the crystalline organic fine particles each contain at least one selected from the group consisting of fatty acid having an alkyl chain having 8 or higher carbon atoms, aliphatic alcohol having an alkyl chain having 8 or higher carbon atoms, and esters, amides and amines thereof.

<4> The method for producing an electrophotographic toner according to any one of <1> to <3>, wherein the crystalline organic fine particles each have a melting point higher than a glass transition temperature Tg of the toner, and wherein the crystalline organic fine particles attached to the surface of the toner base particle form a layer which is provided in an area of the electrophotographic toner, which is from an outermost surface of the toner base particle to an inner part of the toner base particle, a depth of which is expressed by Dv×0.2, where Dv is a volume average particle diameter of the toner.

<5> The method for producing an electrophotographic toner according to any one of <1> to <4>, wherein the forming containing: emulsifying or dispersing the solution or dispersion of the toner material which contains a polymerizable monomer as the binder resin precursor and the colorant in the aqueous medium, so as to form an emulsion or dispersion liquid; and allowing a polymerization reaction to undergo in the emulsion or dispersion liquid.

<6> The method for producing an electrophotographic toner according to any one of <1> to <4>, wherein the forming contains: dispersing the dispersion of the toner material containing a polymerizable monomer as the binder resin precursor and the colorant in the aqueous medium; aggregating the dispersion in the aqueous medium to form aggregates; and heating and fusing the aggregates.

<7> The method for producing an electrophotographic toner according to any one of <1> to <4>, wherein the forming contains: dissolving or dispersing the toner material containing the colorant and any one of the binder resin and the binder resin precursor in an organic solvent, so as to form the solution or dispersion; emulsifying or dispersing the solution or dispersion in the aqueous medium, so as to form an emulsion or dispersion liquid; and removing the organic solvent of the emulsion or dispersion liquid.

<8> The method for producing an electrophotographic toner according to any one of <1> to <4>, wherein the forming contains: dissolving or dispersing the toner material containing an active hydrogen group-containing compound and a polymer reactive with the active hydrogen group-containing compound as the binder resin precursors and the colorant in an organic solvent, so as to form the solution or dispersion; emulsifying or dispersing the solution or dispersion in the aqueous medium; subjecting the active hydrogen group-containing compound and the polymer reactive with the active hydrogen group-containing compound to crosslinking or elongation reaction, so as to form an emulsion or dispersion liquid; and removing the organic solvent of the emulsion or dispersion liquid.

<9> An electrophotographic toner is obtained by a method for producing the electrophotographic toner according to any one of <1> to <8>.

<10> A full-color image forming method containing: charging an electrophotographic photoconductor using a charging unit; exposing the charged electrophotographic photoconductor to light using an exposing unit, so as to form a latent electrostatic image thereon; developing the latent electrostatic image formed on the electrophotographic photoconductor with the electrophotographic toner according to <9> using a developing unit, so as to form a toner image; transferring the toner image formed on the electrophotographic photoconductor via an intermediate transfer medium or directly onto a recording medium; fixing the transferred toner image on the recording medium using a fixing unit containing a heat and pressure fixation member; and cleaning a residual toner adhering onto a surface of the electrophotographic photoconductor after the transferring using a cleaning unit.

<11> The full-color image forming method according to <10>, wherein the method employs a tandem image forming apparatus.

<12> A full-color image forming apparatus containing: an electrophotographic photoconductor; a charging unit configured to charge the electrophotographic photoconductor; an exposing unit configured to expose the charged electrophotographic photoconductor to light, so as to form a latent electrostatic image thereon; a developing unit housing the electrophotographic toner according to <9> therein, and configured to develop the latent electrostatic image formed on the electrophotographic photoconductor with the electrophotographic toner, so as to form a toner image; a transfer unit configured to transfer the toner image formed on the electrophotographic photoconductor via an intermediate transfer medium or directly onto a recording medium; a fixing unit containing a heat and pressure fixation member, and configured to fix the transferred toner image on the recording medium using the heat and pressure fixation member; and a cleaning unit configured to clean a residual toner adhering onto a surface of the electrophotographic photoconductor after the toner image has been transferred.

<13> The full-color image forming apparatus according to <12>, wherein the full-color image forming apparatus contains a plurality of process cartridges each contain at least an electrophotographic photoconductor.

The present invention can solve the conventional problems and achieve the object, and can provide a method for producing an electrophotographic toner, which can improve transfer efficiency, cause no image defect upon transferring and output images with excellent reproducibility for a long period of time, and improve fixing ability in high-speed full-color image formation, the electrophotographic toner, a full-color image forming method, and a full-color image forming apparatus.

BRIEF DESCRIPTION OF THE DRAWINGS

FIG. 2A is an example of an explanatory diagram of a flow tester measurement method.

FIG. 2B is another example of the explanatory diagram of the flow tester measurement method.

FIG. 3 is a diagram showing a structure of an embodiment of a charging unit serving as a charging unit used in the full-color image forming method and full-color image forming apparatus of the present invention.

FIG. 6 is a diagram showing a structure of an embodiment of a fixing device serving as a fixing unit used in the full-color image forming method and the of full-color image forming apparatus of the present invention.

DETAILED DESCRIPTION OF THE INVENTION

The best mode for carrying out the present invention will be described optionally with reference to the accompanying drawings. The aspects of the present invention can be easily properly altered or modified by the so-called person ordinary skill in the art to constitute other embodiments, and these alterations and modifications are included in the present invention. The following descriptions are examples of preferred embodiments of the invention and do not limit the present invention.

(Method for Producing Electrophotographic Toner and Electrophotographic Toner)

A method for producing an electrophotographic toner (hereinafter, simply referred to as "toner") of the present invention includes a toner base particle forming step, which includes emulsifying or dispersing a solution or dispersion of a toner material containing a colorant, and any one of a binder resin and a binder resin precursor in an aqueous medium, and adding crystalline organic fine particles having an acid value of 20 mgKOH/g to 80 mgKOH/g into the aqueous medium, before, during or after the forming the toner base particle, so as to attach the crystalline organic fine particles onto a surface of the toner base particle.

The toner base particle forming step may be performed by an emulsion polymerization coagulation process, a suspension polymerization process, or a dissolution suspension process. The method for producing the electrophotographic toner of the present invention includes adding the crystalline organic fine particles into the aqueous medium, before, during or after the toner base particle forming step, and if necessary, may further include other steps.

An electrophotographic toner of the present invention contains at least a binder resin, a colorant, and crystalline organic fine particles having an acid value of 20 mgKOH/g to 80 mgKOH/g, and if necessary, further contains other components. The electrophotographic toner of the present invention is produced by the method for producing the electrophotographic toner of the present invention.

Onto the surface of the toner base particle produced by the method for producing the electrophotographic toner of the present invention, the crystalline organic fine particles adhere. The thus produced toner preferably has a weight average particle diameter of 1 μm to 6 μm.

Figure 1A:
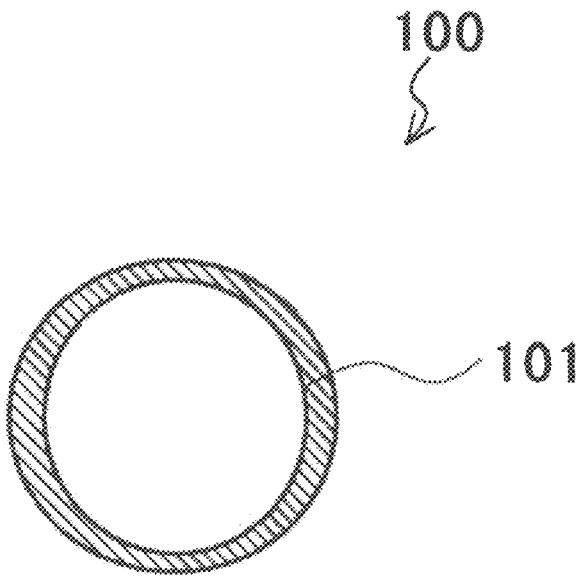
FIG. 1A is an example of a diagram showing a structure of a toner of the present invention.
Figure 1B:
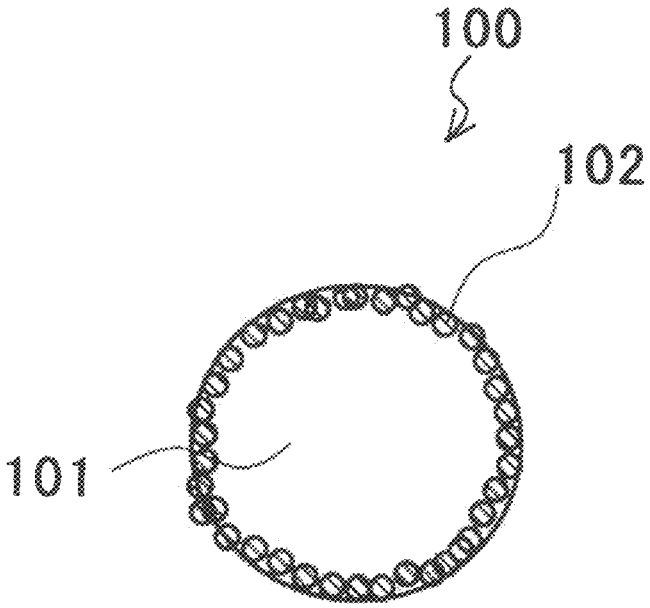
FIG. 1B is another example of a diagram showing the structure of the toner of the present invention.

FIGS. 1A to 1B are diagrams each showing a structure of the toner of the present invention.

As shown in FIG. 1B, the toner 100 produced by the above-described method is formed of a toner base particle 101, and crystalline organic fine particles 102 adhering to a surface of the toner base particle 101, which is formed of a toner material mainly containing a colorant and a binder resin as a core. Since the crystalline organic fine particles 102 each have a small particle diameter, the crystalline organic fine particles 102 are embedded in the toner base particle 101, and adhere to the toner base particle 101. The average particle diameter of the toner 100 is adjusted by altering the conditions of emulsification or dispersion, such as stirring of an aqueous medium in an emulsification step. The crystalline organic fine particles 102 may be fused and adhere to each other, to thereby form a layer.

Here, the toner surface in which the crystalline organic fine particles 102 are present is an area of the toner, which is from an outermost surface of the toner base particle to an inner part of the toner base particle, a depth of which is equal to or larger than a diameter of each of the crystalline organic fine particles 102, specifically, is expressed by Dv×0.2, where Dv is a volume average particle diameter of the toner.

In general, in an electrophotographic image forming apparatus, when a toner having a small particle diameter is used, non-electrostatic adhesion between the toner particle and the electrophotographic photoconductor or between the toner particle and the intermediate transfer medium, such as an intermediate transfer belt is increased and, thus, the transfer efficiency is further lowered. In particular, when the toner having a small particle diameter is used in a high-speed machine, it is known that, in addition to an increase in non-electrostatic adhesion between the toner particle and the intermediate transfer medium due to the reduced particle diameter of the toner, according to speeding-up, the period of time for which the toner particle is exposed to a transfer electric field in a nip part in transfer, particularly in the nip part in the secondary transfer, is shortened, and, thus, the transfer efficiency in the secondary transfer is significantly lowered.

In the toner produced by the production process according to the present invention, however, due to the fact that organic fine particles formed of a crystalline material adhering onto the toner surface and such crystalline organic fine particles have a certain hardness, the non-electrostatic adhesion of the toner is lowered and, thus, even when the transfer time is shortened as in an image forming apparatus having high process speed, satisfactory transfer efficiency can be realized without sacrificing the fixing ability.

Further, since the crystalline organic fine particles have a satisfactory hardness, even when a temporal mechanical stress is large as in the image forming apparatus having high process speed, the crystalline organic fine particles having a large particle diameter adhering onto the toner surface can exist without being embedded in the toner. Accordingly, satisfactory transfer efficiency can be maintained for a long period of time. At the same time, the embedding of an external additive adhering onto the toner surface can also be prevented.

According to the method for producing a toner of the present invention, the crystalline organic fine particles are added before production of the toner base particles or after production of the toner base particles. In this timing, the organic solvent is present in liquid droplets of the toner composition. Accordingly, a desired form as shown in FIG. 1B can be realized in which, after the adherence of the crystalline organic fine particles on the surface of a liquid droplet, the crystalline organic fine particles enter the liquid droplet from the surface thereof to some extent and, after the removal of the aqueous medium, the crystalline organic fine particles are attached and fixed onto the surface of the toner base particle.

In order to attain the object of the present invention, the toner is preferably regulated so as to have a weight average particle diameter of 1 μm to 6 μm. In particular, the weight average particle diameter of the toner is more preferably 2 μm to 5 μm. When the weight average particle diameter of the toner is lower than 1 μm, toner dust is likely to be produced in the primary transfer and the secondary transfer. On the other hand, when the weight average particle diameter of the toner is larger than 6 μm, the dot reproducibility is unsatisfactory and the granularity of a halftone part is also deteriorated, possibly failing to form a high-definition image.

Onto the toner surface, it is preferred that the crystalline organic fine particles having a primary average particle diameter of 20 nm to 500 nm be attached and fixed. In particular, the adhesion and fixation of the crystalline organic fine particles having a particle diameter of 50 nm to 300 nm are preferred. By virtue of this, the non-electrostatic adhesion of the toner can be reduced by a spacer effect. Further, even when the temporal mechanical stress is large as in the image forming apparatus having high process speed, an increase in non-electrostatic adhesion by the embedding of the crystalline organic fine particles in the toner surface can be suppressed, and consequently, satisfactory transfer efficiency can be maintained for a long period of time.

In particular, when an image forming process includes two transfer steps of a primary transfer step and a secondary transfer step in an intermediate transfer system, the toner produced by the production process of the present invention is very useful. The effect is particularly significant in a relatively high-speed image forming process, for example, transfer linear velocity is 300 mm/sec to 1,000 mm/sec, and the transfer time in a secondary nip portion is 0.5 msec to 20 msec. In a process in which the linear velocity is lower, or the secondary transfer time is shorter than the above range, there is little difference between the toner of the present invention and the toner in which the crystalline organic fine particles are not present in the toner surface. On the other hand, in the case of higher-speed linear velocity over the above-described range, degradation in transfer efficiency cannot be prevented without difficulties.

When the primary average particle diameter of the crystalline organic fine particles is smaller than 20 nm, the spacer effect is unsatisfactory and, consequently, the non-electrostatic adhesion of the toner cannot be reduced. Further, the temporal mechanical stress is large as in the high-speed machine, the crystalline organic fine particles or the external additive is likely to be embedded in the toner. In this case, there is a possibility that satisfactory transfer efficiency cannot be maintained for a long period of time. On the other hand, when the primary average particle diameter of the crystalline organic fine particles is larger than 500 nm, the fluidity of the toner is deteriorated and the uniform transferability may be inhibited.

In general, in the toner filled into a developing device, the crystalline organic fine particles in the toner surface are embedded inside the toner by mechanical stress mainly in the developing device or are moved in concaves on the surface of the toner base particle and, consequently, the adhesion reduction effect is lost. Further, the external additive is exposed to a similar stress and is consequently embedded inside the toner, and thus, the adhesion of the toner is increased.

By contrast, the toner produced by the method for producing a toner of the present invention has relatively large crystalline organic fine particles, and thus is less likely to be embedded in the toner base particle. In particular, the crystalline organic fine particles may be formed of a partly crosslinked resin containing crystalline polyester polymer. Such crystalline organic fine particles are relatively hard. Accordingly, the crystalline organic fine particles are not deformed on the surface of the toner base particle by the mechanical stress within the developing device and can maintain the spacer effect, to thereby prevent the external additive from embedding in the toner, and be suitable for maintaining adhesion. Moreover, the partly crosslinked resin can prevent decrase of fixing ability.

It is preferred that the crystalline organic fine particles fuse together with the binder resin, so as to increase adhesion strength. However, when the crystalline organic fine particles completely fuse with the binder resin, the crystalline organic fine particles cannot be distinguished from the binder resin and therefore cannot exert effect thereof. Therefore, each of the crystalline organic fine particles preferably has a different polarity from that of the binder resin, and has polarity higher than that of the binder resin. By giving such polarity to the crystalline organic fine particles, the crystalline organic fine particles do not enter inside of the binder resin, but are present between the aqueous medium and the surface of the toner base particle.

Since each of the crystalline organic fine particles have a melting point higher than a glass transition temperature Tg of the toner, the toner particles do not fuse with each other during storage at high temperature. Moreover, since each of the crystalline organic fine particles have a melt viscosity lower than that of the binder resin inside the toner base particle upon heating, dissolution adhesion is rapidly performed at low temperature, and thus low temperature fixing ability of the toner can be secured.

The melt viscosity outstandingly appears according to the difference between a flow start temperature and a flow end temperature in a flow tester, and the smaller the difference is, the smaller the melt viscosity is. In the toner of the present invention, it is necessary that the difference between a flow start temperature and a flow end temperature of each of the crystalline organic fine particles is smaller than that of the toner.

It is preferred that the crystalline organic fine particles be attached and fixed onto the toner surface. In order to achieve adhesion of the crystalline organic fine particles to the toner surface during toner base particle forming step, the difference between the polarity of the crystalline organic fine particles and that of the resin contained in the toner is important. Since the adhesion is achieved by electrical attraction in the aqueous phase, the difference between the polarity of each of the crystalline organic fine particle and that of the toner base particle may control charge in water in many cases.

After the crystalline organic fine particles adhere onto the toner base particle, it is necessary that the crystalline organic fine particles be present without being compatible with, but separated from the resin contained in the toner base particle even under the conditions of heat treatment, or the presence of a solvent or a monomer. To this end, the difference between the polarity of each of the crystalline organic fine particle and that of the resin contained in the toner is important.

It is preferred that the acid value of the resin contained in the crystalline organic fine particle is higher than that of the resin contained in the toner. Generally, the acid value of the resin contained in the toner is 20 mgKOH/g or less, and in the present invention the acid value of the resin contained in the crystalline organic fine particle is 20 mgKOH/g to 80 mgKOH/g.

Moreover, the hydroxyl value of a polyester resin contained in the crystalline organic fine particles is preferably higher than that of the resin contained in the toner. The difference of the hydroxyl value of the polyester resin contained in the crystalline organic fine particle and that of the resin contained in the toner is preferably 1 mgKOH/g to 50 mgKOH/g, more preferably 5 mgKOH/g to 30 mgKOH/g.

As the toner base particle forming step in the method for producing a toner of the present invention, for example, a suspension polymerization process, an emulsion polymerization coagulation process, and the like may be employed. In a method of emulsifying a toner material using an organic solvent, a polyester resin is preferably used as the binder resin.

In the emulsification step, when the crystalline organic fine particles are added before emulsification or after emulsification, the organic solvent is present within the liquid droplets of the toner material. Accordingly, disadvantageously, the crystalline organic fine particles may be dissolved into the liquid droplets after the crystalline organic fine particles adhere onto the surface of the liquid droplets. When the resin component for forming the toner is a polyester resin and the crystalline organic fine particles are partly crosslinked, or crystalline organic fine particles formed of polyester resins having high polarity, the compatibility between the resins is so poor that the crystalline organic fine particles are not compatible with liquid droplets of the toner material and are present in a state that crystalline organic fine particles adhering to the liquid droplets.

Accordingly, a desired form can be realized in which the crystalline organic fine particles enter the liquid droplets from the surface thereof to some extent and, after the removal of the organic solvent, the crystalline organic fine particles are attached and fixed onto the surface of the toner base particle.

The crystalline organic fine particles preferably have properties of forming no aggregate in an aqueous solution containing a surfactant. In the method for production a toner of the present invention, when the crystalline organic fine particles are added before emulsification or after emulsification in the emulsification step, it is not preferred that the crystalline organic fine particles are presence stably and independently without adherence onto liquid droplets of the toner material. When the crystalline organic fine particles have the properties of forming no aggregate in the aqueous medium containing the surfactant, the crystalline organic fine particles present in the aqueous phase, before, during or after the emulsification can be moved onto the surface of the liquid droplet of the toner material and can easily adhere onto the surface of the liquid droplet of the toner material. Specifically, in general, the crystalline organic fine particles are stable in the aqueous medium containing the surfactant. However, when the liquid droplets of the toner material are present, and the attraction force between the crystalline organic fine particles and the droplets of the toner material are strong, a composite of dissimilar particles is formed.

The resultant composite as such exhibits a high level of adhesion. The composite can be fixed more strongly on the surface of the toner base particle in such a manner that after the emulsification, the crystalline organic fine particles are moved to the surface of the liquid droplet of the toner material, and then adhere thereto, followed by heating. Preferably, the fixing temperature is higher than the glass transition temperature of the resin used for the toner.

The toner material preferably contains an active hydrogen group-containing compound and a modified polyester resin reactive with the compound. When the active hydrogen group-containing compound and the modified polyester resin reactive with the compound are present in the liquid droplets of the toner material, the mechanical strength of the toner is enhanced and the embedding of the crystalline organic fine particles and the external additive can be suppressed. When the active hydrogen group-containing compound has a cationic polarity, anionic crystalline organic fine particles can be electrostatically attracted. Further, the fluidity of the toner in the heat fixation can be regulated, and the fixing temperature width can also be broadened.

The amount of the crystalline organic fine particles is preferably 0.5% by mass to 5% by mass, particularly preferably 1% by mass to 4% by mass, relative to 100% by mass of the toner. When the amount of the crystalline organic fine particles is smaller than 0.5% by mass, the spacer effect is unsatisfactory, and consequently, the non-electrostatic adhesion of the toner particle cannot be reduced. On the other hand, when the amount of the crystalline organic fine particles is larger than 5% by mass, the fluidity of the toner is deteriorated. As a result, uniform transferability is inhibited, or the crystalline organic fine particles cannot be satisfactorily fixed to the toner and is likely to be separated. Therefore, there is a possibility that the crystalline organic fine particles adhere onto a carrier and an electrophotographic photoconductor (hereinafter, simply referred to as photoconductor) or the like, possibly causing contamination of the photoconductor.

The average circularity of the toner particles produced by the method for producing a toner of the present invention is preferably 0.95 to 0.99. When the average circularity of the toner particles is less than 0.95, the image uniformity upon development is deteriorated, or the transfer efficiency of the toner from a photoconductor to an intermediate transfer medium or from an intermediate transfer medium to a recording medium may be lowered. Consequently, uniform transfer may not be realized. The toner produced by the method for producing a toner of the present invention is preferably produced through emulsification process in the aqueous medium, in advance of an aqueous dispersion production step using the aqueous medium. The toner particle is effective in reducing the particle diameter of the color toner and in realizing a toner shape having an average circularity in the above-defined range.

The ratio of the weight average particle diameter (Dw) to the number average particle diameter (Dn), i.e., Dw/Dn, in the toner produced by the method for producing the toner of the present invention is not particularly limited and may be appropriately selected depending on the intended purpose. The ratio Dw/Dn is preferably 1.30 or less, more preferably 1.00 to 1.30. When the ratio Dw/Dn is less than 1.00, the following problems occur. Specifically, in the case of a two-component developer, toner fuses and adheres to a carrier surface during long term stirring in a developing device, which may cause decrease in the charging ability of the carrier, and poor cleanability. In the case of a one-component developer, toner filming to a developing sleeve or toner fusion to members, such as a blade to form a thin toner film, may easily occur. On the other hand, when the ratio Dw/Dn exceeds 1.30, it becomes difficult to provide a high-resolution, high-quality image, and variations in toner particle diameter may increase after toner consumption or toner supply in a developer. When the ratio Dw/Dn is 1.00 to 1.30, the resultant toner is excellent in all of storage stability, low temperature fixing ability, and hot offset resistance.

In particular, when such toner is used in a full-color image forming apparatus, images having excellent gloss can be obtained. When the ratio Dw/Dn is within the above-described range, in the case of the two-component developer, variations in toner particle diameter in a developer are small even after toner consumption and toner supply have been repeated for a long time, and in addition, even after a long time stirring in the developing device, excellent developing ability can be ensured. Moreover, when this requirement is met in the case of the one-component developer, variations in toner particle diameter decrease even after toner consumption or toner supply, and toner filming to a developing sleeve and toner fusing to members, such as a blade to form a thin toner film, are prevented, and in addition, even after long-time use of the developing device, i.e. long-time stirring of developer, excellent and stable developing ability can be ensured. Thus, a high-quality image can be obtained.

The particle diameter of a carrier used in combination with the toner produced by the method for producing a toner of the present invention is not particularly limited and may be appropriately selected depending on the intended purpose. The weight average particle diameter of the carrier is preferably 15 μm to 40 μm. When the weight average particle diameter is smaller than 15 μm, carrier adhesion, which is a phenomenon that the carrier is also disadvantageously transferred in the transfer step, is likely to occur. When the weight average particle diameter is larger than 40 μm, the carrier adhesion is less likely to occur. In this case, however, when the toner density is increased to provide a high image density, there is a possibility that background smear is likely to occur. Further, when the dot diameter of a latent image is small, variation in dot reproducibility is so large that the granularity in highlight parts may be degraded.

(Full-Color Image Forming Method and Full-Color Image Forming Apparatus)

A full-color image forming method of the present invention includes a charging step of charging an electrophotographic photoconductor as an image bearing member using a charging unit, an exposing step of exposing the charged electrophotographic photoconductor to light using an exposing unit, so as to form a latent electrostatic image thereon, a developing step of developing the latent electrostatic image on the electrophotographic photoconductor with a toner using a developing unit containing the toner so as to form a toner image, a transfer step of transferring the toner image formed on the electrophotographic photoconductor via an intermediate transfer medium or directly onto a recording medium, a fixing step of fixing the transferred toner image on the recording medium using a fixing unit including a heat and pressure fixation member, and a cleaning step of cleaning the toner remaining and adhering onto a surface of the electrophotographic photoconductor, from which the toner image has been transferred to the intermediate transfer medium or directly to the recording medium using the transfer unit, using a cleaning unit, and if necessary further includes other steps. The toner used in the developing step is the toner produced by the method for producing the toner of the present invention. In the case where the transfer step is performed via the intermediate transfer medium, the transfer step includes a primary transfer step of primarily transferring the toner image formed on the electrophotographic photoconductor onto the intermediate transfer medium, and a secondary transfer step of secondarily transferring the toner image, which has been transferred onto the intermediate transfer medium, onto the recording medium. In the full-color image forming method, in the secondary transfer step, the linear velocity of transferring the toner image onto the recording medium, i.e., printing speed, is 300 mm/sec to 1,000 mm/sec, and the transfer time at a nip portion in the secondary transfer unit is preferably 0.5 msec to 20 msec.

The full-color image forming apparatus of the present invention includes an electrophotographic photoconductor, a charging unit configured to charge the electrophotographic photoconductor, an exposing unit configured to expose the charged electrophotographic photoconductor to light so as to form a latent electrostatic image thereon; a developing unit housing an electrophotographic toner therein, and configured to develop the latent electrostatic image formed on the electrophotographic photoconductor with the electrophotographic toner, so as to form a toner image; a transfer unit configured to transfer the toner image formed on the electrophotographic photoconductor via an intermediate transfer medium or directly onto a recording medium; a fixing unit containing a heat and pressure fixation member, and configured to fix the transferred toner image on the recording medium using the heat and pressure fixation member; and a cleaning unit configured to clean a residual toner adhering onto a surface of the electrophotographic photoconductor, from which the toner image has been transferred to the intermediate transfer medium or the recording medium using the transfer unit, and if necessary, further includes other units. In the full-color image forming apparatus, the electrophotographic toner of the present invention is used.

Moreover, the full-color image forming apparatus of the present invention preferably a tandem image forming apparatus, which includes a plurality of electrophotographic photoconductors, a plurality of sets of a charging unit, an exposing unit, a developing unit, a transfer unit, and a cleaning unit, corresponding to the plurality of the electrophotographic photoconductors. The full-color image forming apparatus of the present invention preferably include a plurality of process cartridges each including at least an electrophotographic photoconductor.

In the so-called tandem type in which a plurality of electrophotographic photoconductors are provided, and development is carried out one color by one color upon each rotation, a latent electrostatic image formation step and a development and transfer step are carried out for each color to form each color toner image. Accordingly, the difference in speed between single color image formation and full color image formation is so small that the tandem type can advantageously apply to high-speed printing. In this case, the color toner images are formed respectively on separate electrophotographic photoconductors, and the color toner layers are stacked, i.e., color superimposition, to form a full color image. Accordingly, when there are variations in properties, for example, a difference, for example, in charging ability between color toners exists, a difference in amount of the development toner occurs between the color toners. As a result, a change in hue of secondary color by color superimposition is increased, and the color reproducibility is lowered.

It is necessary for the toner used in the tandem image forming method to satisfy the requirements that the amount of the development toner for regulating the balance of the colors is stabilized (no variation in developing toner amount between respective color toners), and the adherence to the electrophotographic photoconductor and to the recording medium is uniform between the respective color toners. With respect to these points, the toner produced by the method for producing a toner of the present invention is preferable.

The charging device serving as a charging unit preferably applies at least an alternating voltage superimposed on direct voltage. The application of the alternating voltage superimposed on direct voltage can stabilize the surface voltage of the electrophotographic photoconductor to a desired value as compared with the application of only a direct current voltage. Accordingly, further uniform charging can be realized.

The charging unit preferably performs charging by bringing a charging member, such as a charging roller, and a charging brush, into contact with the electrophotographic photoconductor and applying the voltage to the charging member. When charging is carried out by bringing the charging member into contact with the electrophotographic photoconductor and applying the voltage to the charging member, the effect of uniform charging ability attained by applying the alternating voltage superimposed on direct voltage can be further improved.

The fixing unit serving as a fixing device including a heating roller that is formed of a magnetic metal and is heated by electromagnetic induction; a fixation roller disposed parallel to the heating roller; an endless belt-like toner heating medium, so-called a heating belt, that is stretched around the heating roller and the fixation roller and rotated by these rollers, while being heated by the heating roller; and a pressure roller that is brought into pressure contact with the fixation roller through the heating belt and is rotated in a forward direction relative to the heating belt to form a fixation nip part. The fixing step can realize a temperature rise in the fixation belt in a short time and can realize stable temperature control. Further, even when a recording medium having a rough surface is used, during the fixation, the fixation belt acts in conformity to the surface of the recording medium to some extent and, consequently, satisfactory fixing ability can be realized.

The fixing unit is preferably of an oil-less type or a minimal oil-coated fixing type. To this end, preferably, the toner particles to be fixed contain a finely dispersed releasing agent, such as wax, in the toner particles. In the toner in which the releasing agent is finely dispersed in the toner particle, the releasing agent is likely to ooze out during fixation. Accordingly, in the oil-less fixing device or in the minimal oil-coated fixing device, the same effect as application of the releasing agent can be achieved.

Moreover, the transfer of the toner to the belt can be suppressed. In order that the releasing agent is present in a dispersed state in the toner particle, preferably, the releasing agent and the binder resin are not compatible with each other. The releasing agent can be finely dispersed in the toner particle, for example, by taking advantage of the shear force of kneading during the toner production. The dispersion state of the releasing agent can be determined by observing a thin film section of the toner particle under a transmission electron microscope TEM. The dispersion diameter of the releasing agent is preferably small. However, when the dispersion diameter is excessively small, the releasing agent may not be sufficiently oozed out during the fixation. Accordingly, when the releasing agent can be observed at a magnification of 10,000 times, it can be determined that the releasing agent is present in a dispersed state. When the releasing agent is so small that the releasing agent cannot be observed at a magnification of 10,000 times, the releasing agent may not be sufficiently oozed out upon fixation even when the releasing agent is finely dispersed in the toner particle.

<Measurement Method of Toner Properties>

<<Weight Average Particle Diameter Dw, Volume Average Particle Diameter Dv and Number Average Particle Diameter Dn>>

The weight average particle diameter Dw, the volume average particle diameter Dv and the number average particle diameter Dn of the toner are measured using a particle size analyzer ("MULTISIZER III," manufactured by Beckman Coulter Inc.) with an aperture having a diameter of 100 μm, and then analyzed with an analysis software (Beckman Coulter MULTISIZER 3 Version 3.51). More specifically, 0.5 mL of a 10% by mass surfactant, alkylbenzene sulfonate, Neogen SC-A, manufactured by Daiichi Kogyo Seiyaku Co., Ltd. is charged into a 100 mL-glass beaker, and 0.5 g of a toner sample is added thereto, followed by stirring with a microspatula. Subsequently, 80 mL of ion-exchanged water is added into the beaker. The obtained dispersion liquid is subjected to dispersion treatment for 10 min using an ultrasonic wave dispersing device (W-113MK-II, manufactured by Honda Electronics Co., Ltd.).

The resultant dispersion liquid is measured using MULTISIZER III and ISOTON III (manufactured by Beckman Coulter Inc.) serving as a solution for measurement. The dispersion liquid containing the toner sample is dropped so that the concentration indicated by the device falls within a range of 8%±2%. In this measuring method, it is important in terms of reproducibility of measuring the particle size that the concentration is adjusted to the range of 8%±2%. When the concentration indicated by the device falls within the range of 8%±2%, no error is occurred in the measurement of the particle size.

<<Average Circularity>>

The average circularity of the toner is defined by the following equation.

Average circularity SR=(Circumferential length of a circle having the same area as projected particle area/Circumferential length of projected particle image)×100(%)

The average circularity of the toner is measured using a flow-type particle image analyzer ("FPIA-2100," manufactured by SYSMEX CORPORATION), and analyzed using an analysis software (FPIA-2100 Data Processing Program for FPIA Version00-10).

Specifically, into a 100 mL glass beaker, 0.1 mL to 0.5 mL of a 10% by mass surfactant NEOGEN SC-A, an alkylbenzene sulfonate, manufactured by Dai-ichi Kogyo Seiyaku Co., Ltd. is charged, and 0.1 g to 0.5 g of a toner is added, followed by stirring with a microspatula. Subsequently, 80 mL of ion-exchanged water is added into the beaker. The obtained dispersion liquid is subjected to dispersion treatment for 3 min using an ultrasonic wave dispersing device (manufactured by Honda Electronics Co., Ltd.). Using FPIA-2100, the shape and distribution of toner particles are measured until the dispersion liquid has a concentration of 5,000 number per μL to 15,000 number per μL. In this measuring method, it is important in terms of reproducibility in measuring the average circularity that the concentration of the dispersion liquid is adjusted to the range of 5,000 number per μL to 15,000 number per μL.

To obtain the above-mentioned concentration of the dispersion liquid, it is necessary to change the conditions of the dispersion liquid, namely the amounts added of the surfactant and of the toner. The required amount of the surfactant varies depending on the hydrophobicity of the toner, similar to the measurement of the toner particle diameter. When the surfactant is added in large amounts, noise is caused by foaming. When the surfactant is added in small amounts, the toner cannot be sufficiently wetted, leading to insufficient dispersion. Also, the amount of the toner added varies depending on its particle diameter. When the toner has a small particle diameter, it needs to be added in small amounts. When the toner has a large particle diameter, it needs to be added in large amounts. In the case where the toner particle diameter is 3 μm to 7 μm, the dispersion liquid concentration can be adjusted to the range of 5,000 number per μL to 15,000 number per μL by adding 0.1 g to 0.5 g of the toner.

<Method for Measuring Properties of Carrier>

<<Weight Average Particle Diameter>>

The weight average particle diameter Dw of the carrier is calculated on the basis of the particle size distribution of the particles measured on a number basis; i.e., the relation between the number based frequency and the particle diameter. In this case, the weight average particle diameter Dw is expressed by Equation (1):

$$Dw=\{1/\Sigma(nD^3)\}\times\{\Sigma(nD^4)\} \quad \text{Equation (1)}$$

in Equation (1) D represents a typical particle diameter (μm) of particles present in each channel, and "n" represents the total number of particles present in each channel. It should be noted that each channel is a length for equally dividing the range of particle diameters in the particle size distribution chart, and 2 μm is employed for each channel in the present invention. For the typical particle diameter of particles present in each channel, the minimum particle diameter of the particles present in each channel is employed.

In addition, the number average particle diameter Dp of the carrier or the core material particles are calculated on the basis of the particle size distribution measured on a number basis. The number average particle diameter Dp is expressed by Equation (2):

$$Dp=(1/\Sigma N)\times(\Sigma nD) \quad \text{Equation (2)}$$

in Equation (2) N represents the total number of particles measured, "n" represents the total number of particles present in each channel and D represents the minimum particle diameter of the particles present in each channel (2 μm).

For a particle size analyzer used for measuring the particle size distribution, a micro track particle size analyzer (Model HRA9320-X100, manufactured by Honewell Co.) may be used. The measurement conditions are as follows.

(1) Range of particle diameters: 8 μm to 100 μm (2) Channel length (width): 2 μm (3) Number of channels: 46

(4) Refraction index: 2.42

Hereinafter, a method for producing a toner of the present invention will be specifically described.

It is noted that the present invention is not limited to the exemplary method for producing a toner in this specification.

In order to form a structure that the crystalline organic fine particles are attached and fixed onto the surface of the toner base particle, the crystalline organic fine particles having a primary average particle diameter of 20 nm to 500 nm are added into an aqueous medium before an organic solvent is removed in a toner production method. In this toner production method, a toner material is dissolved or dispersed in the organic solvent to form a solution or dispersion liquid, and the solution or dispersion liquid of the toner material is emulsified or dispersed in the aqueous medium, to which an anionic surfactant and crystalline organic fine particles having a primary average particle diameter of 20 nm to 500 nm are added, followed by removing the organic solvent, to thereby produce a toner.

For emulsification and dispersion, a dispersant is preferably used, if necessary for stabilizing oil droplets (i.e. droplets of the emulsified product or dispersed product), and attaining a sharp particle size distribution of the resulting toner as well as desirable particle shape of the toner. The dispersant is not particularly limited and may be appropriately selected depending on the intended purpose. Examples thereof include surfactants, sparingly water soluble inorganic dispersants and polymer protective colloids. These may be used alone or in combination. Of these, surfactants are preferable.

<Material for Toner Production of the Present Invention>

<<Crystalline Organic Fine Particles>>

Generally, an organic low molecular weight compound having high purity has crystallinity. Thus, such organic low molecular weight compound can be used as a material for forming the crystalline organic fine particles, as long as it has a melting point higher than the glass transition temperature Tg of the toner.

The crystalline organic fine particles are not particularly limited and may be appropriately selected depending on the intended purpose, as long as they have crystallinity. The crystalline organic fine particles each preferably contain at least a component selected from the group consisting of fatty acid having an alkyl chain having 8 or higher carbon atoms, aliphatic alcohol having an alkyl chain having 8 or higher carbon atoms, and esters, amides and amines thereof.

In particular, when the crystalline organic fine particles are selected from polymer, crystalline polyester resin fine particles exemplified below may be used.

The glass transition temperatures Tg of the amorphous polymer and the crystalline polyester resin used in the present invention is preferably 35° C. to 100° C., more preferably 50° C. to 80° C. from the standpoint of the balance between the storage stability and toner fixing ability. When the glass transition temperature Tg is lower than 35° C., possibly causing toner blocking, which is a phenomenon that toner particles aggregate to thereby form agglomeration during storage of the toner or in a developing device. When the glass transition temperature Tg is higher than 100° C., the fixing temperature of the formed toner increases.

—Crystalline Polyester Resin Fine Particles—

In the toner of the present invention, use of the crystalline organic fine particles formed of a polyester resin is advantageous, as a dispersion liquid of such particles can be easily prepared by emulsifying or dispersing the crystalline organic fine particles with adjusting the acid value of the polyester resin, or using an ionic surfactant. The polyester resin used for emulsification or dispersion are synthesized by dehydration condensation of polycarboxylic acid and polyhydric alcohol. Examples of the polycarboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; alicyclic carboxylic acids such as cyclohexane dicarboxylic acid. These may be used alone or in combination. Of these polycarboxylic acids, aromatic carboxylic acids are preferably used. It is preferred that dicarboxylic acid be combined with tri- or higher carboxylic acid (trimellitic acid, acid anhydride thereof or the like) to form a cross-linked structure or branch structure for securing suitable fixing ability. Examples of the polyhydric alcohol include aliphatic diols, such as ethylene glycol, diethylene glycol, triethylene glycol, propylene glycol, butanediol, hexanediol, neopentylglycol, and glycerine; alicyclic diols, such as cyclohexanediol, cyclohexanedimethanol, hydrogenated bisphenol A; bisphenol A ethylene oxide adducts; and aromatic diols, such as bisphenol A propylene oxide adducts. These may be used alone or in combination. Of these polyhydric alcohols, aliphatic diols are preferable. Diol may be combined with trihydric or higher alcohol (glycerin, trimethylolpropane, pentaerythritol) to form a cross-linked structure or branch structure for securing suitable fixing ability.

To the polyester resin obtained by polycondensation of polycarboxylic acid and polyhydric alcohol, monocarboxylic acid and/or monoalcohol is added, so as to esterify a hydroxyl group and/or carboxyl group at a terminal of polymerization, to thereby adjust the acid value of the polyester resin. Examples of the monocarboxylic acid include acetic acid, acetic anhydride, benzoic acid, trichloroacetic acid, trifluoroacetic acid and propionic anhydride. Examples of the monoalcohol include methanol, ethanol, propanol, octanol, 2-ethylhexanol, trifluoroethanol, trichloroethanol, hexafluoroisopropanol and phenol.

The polyester resin can be produced by condensation reaction of the polycarboxylic acid and the polyhydric alcohol by ordinary methods. For example, the polyester resin can be produced in such a manner that the polycarboxylic acid and the polyhydric alcohol, and if necessary, a catalyst are charged in a reaction vessel equipped with a thermometer, a stirrer, and a flow down type condenser, the mixture is heated at 150° C. to 250° C. in the presence of inactive gas such as nitrogen, the low molecular weight compound obtained as a by-product is continuously removed from the reaction system, and then the reaction is terminated upon reaching a predetermined acid value, followed by cooling down, to thereby obtain a desired reaction product.

As the catalyst used for synthesis of the polyester resin an esterification catalyst may be used. Examples thereof include organic metals such as dibutyltin dilaurate, dibutyltin oxide; metallic alkoxide such as tetrabutyl titanate. The amount of the catalyst is preferably 0.01% by mass to 1% by mass, relative to the total amount of the material for the polyester resin.

The molecular weight of a polyester resin used for the toner of the present invention can be measured by a molecular weight measurement of tetrahydrofuran (THF) soluble matter of the polyester resin through gel permeation chromatography (GPC). The weight average molecular weight Mw of the polyester resin is preferably 5,000 to 1,000,000, more preferably 7,000 to 500,000. The number average molecular weight Mn of the polyester resin is preferably 2,000 to 100,000. The molecular weight distribution Mw/Mn of the polyester resin is preferably 1.5 to 100, more preferably 2 to 60.

When the weight average molecular weight and the number average molecular weight are smaller than the above described range, low temperature fixing ability is effectively achieved, but hot offset resistance is significantly degraded and the glass transition temperature of the surface of toner particle is decreased, adversely affecting storage stability of the toner, for example, toner blocking occurs. On the other hand, when the weight average molecular weight and the number average molecular weight are larger than the above described range, hot offset resistance of the toner can sufficiently achieved, but low temperature fixing ability is decreased, and oozing out of a releasing material phase such as wax in the toner is inhibited, causing curling of a recording medium upon fixation. Thus, by satisfying the above-described conditions, the low temperature fixing ability, hot offset resistance, and prevention of curling can be easily achieved simultaneously.

<Measurement Method of Glass Transition Temperature Tg>

The glass transition temperature Tg of the resin, fixing aid, wax, or toner is measured using DSC system, i.e., a differential scanning calorimeter DSC-60, manufactured by manufactured by SHIMADZU CORPORATION in the following manner.

First, about 10 mg of a toner is placed in an aluminum-sample container, the container is mounted on a holder unit and then set in an electric oven. The sample is heated from room temperature to 150° C. at a temperature increase rate of 10° C./min, left standing at 150° C. for 10 minutes, and then cooled to room temperature and left standing for 10 minutes. The sample is heated again under a nitrogen atmosphere to 150° C. at a temperature increase rate of 10° C./min to thereby measure a DSC curve using a differential scanning calorimeter DSC. Using the analysis system in the DSC system DSC-60, the glass transition temperature Tg is calculated from a tangent point between an endothermic curve obtained near Tg and the base line from the obtained DSC curve.

<Flow Tester Measurement Method>

FIGS. 2A and 2B are explanatory diagrams of a flow tester measurement method.

The softening temperature Ts, flow start temperature Tfb, 1/2 flow temperature T1/2, flow end temperature Te of each of the toner and the crystalline organic fine particles are evaluated in the following manner.

As a flow tester for measuring the thermal properties of the toner, an elevated flow tester CFT500, manufactured by SHIMADZU CORPORATION may be used.

The flow curve obtained by the flow tester represents data shown in FIGS. 2A and 2B, and from which each temperature can be read. In FIG. 2A, B denotes the softening temperature Ts, C denotes the flow start temperature Tfb, and E denotes the flow end temperature Te, and A denotes the 1/2 flow temperature T1/2 in FIG. 2B.

Here, in the present invention, the melting point means the 1/2 flow temperature.

<<Measurement Conditions>>

Load applied: 10 kg/cm$^2$

Temperature increase rate: 3.0° C./min

Die aperture diameter: 0.50 mm

Die length: 10.0 mm

<Measurement of Acid Value>

The acid value of the polyester resin, i.e., the amount (mg) of KOH required for neutralizing 1 g of the resin, is preferably 1 mgKOH/g to 50 mgKOH/g, because arrangement of the crystalline organic fine particles in the surface of the toner base particle, compatibility with the binder resin, and granulation of the toner base particles by emulsification and dispersion method are easily secured, and environmental stability, i.e., stability of charging ability upon variation of humidity or temperature, of the formed toner is suitably maintained with ease.

The acid value of the polyester resin can be regulated by controlling a carboxyl group at the terminal of the polyester, according to a compounding ratio and a reaction rate of the polycarboxylic acid and the polyhydric alcohol in the raw material. Alternatively, by using trimellitic anhydride as the polycarboxylic acid component, the polyester resin having a carboxyl group in a main chain can be obtained.

<<Measurement of Acid Value>>

The acid value is measured under the following conditions and in accordance with the method described in JIS K0070-1992.

To 120 mL of toluene, 0.5 g of a toner as a measurement sample is added and dissolved therein with stirring at room temperature (23° C.) for about 10 hours. Further, 30 mL of ethanol was added to prepare a sample solution.

Calculation for the measurement is carried out using the apparatus described above. Specifically, calculation is carried out as follows: the sample solution is titrated with a previously standardized N/10 caustic potash-alcohol solution, and the acid value is determined according to the following equation, based upon the consumption of the alcohol potash solution.

$$\text{Acid value}=KOH(\text{number of milliliters})\times N\times 56.1/\text{Mass of sample}$$

where N denotes the factor of N/10 KOH.

<<Measurement of Hydroxyl Value>>

The hydroxyl value is measured under the following conditions and in accordance with the method described in JIS K0070-1966.

A sample (0.5 g) is accurately weighed in a 100 mL recovery flask and 5 mL of an acetylated reagent is added thereto. Subsequently, the recovery flask is immersed in a bath and heated at 100° C.±5° C. One hour to two hours later, the flask is taken out from the bath, left standing to cool, and then water is added thereto. Thereafter, the flask is shaken to decompose acetic anhydride. Further, to completely decompose the acetic anhydride, the flask is heated again in the bath for 10 minutes or longer and then left standing to cool. Thereafter, the wall of the flask is washed thoroughly with an organic solvent. This solution is subjected to a potentiometric titration with a N/2 potassium hydroxide ethyl alcohol solution using electrodes to thereby determine a hydroxyl value of the sample.

Note that the acid value and the hydroxyl value can be measured using an automatic potentiometric titrator DL-53 Titrator, manufactured by Metller-Toledo International Inc.

<Method for Producing Organic Fine Particles>

Organic fine particles of polyester resins are formed by heating polyester resins, or dissolving polyester resins in an organic solvent to be swelled, followed by imparting shearing force to an aqueous medium. As a dispersion medium of the crystalline organic fine particle dispersion liquid, an aqueous medium, an organic solvent or the like may be used.

Examples of the aqueous medium include water such as distilled water, ion-exchanged water, and alcohols. These may be used alone or in combination.

In the present invention, a surfactant is preferably added to an aqueous medium in advance. Examples of the surfactant include, but not limited to, anionic surfactants, such as sulfate salt, sulfonate salt, phosphate, and soap; cationic surfactants, such as amine salt, and quaternary ammonium salt; nonionic surfactants, such as polyethylene glycol, alkylphenol ethylene oxide adduct, and polyhydric alcohol.

Of these, the anionic surfactants and the cationic surfactants are preferable. The nonionic surfactants are preferably used in combination with the anionic surfactants or the cationic surfactants.

These surfactants may be used alone or in combination.

Specific examples of the anionic surfactants include sodium dodecylbenzene sulfonate, sodium dodecyl sulfate, sodium alkylnaphthalenesulfonate, sodium dialkyl sulfosuccinate. Specific examples of the cationic surfactants include alkylbenzenedimethylammonium chloride, alkyltrimethylammonium chloride, and distearylammonium chloride. Of these, ionic surfactants such as the anionic surfactants, the cationic surfactants, etc. are preferable.

Examples of the organic solvent include ethyl acetate, and toluene. The organic solvent is suitably selected depending on the types of the binder resin and the binder resin precursor. In the case where the binder resin or the binder resin precursor is dissolved in an oil solvent having relatively low solubility to water, the resin is dissolved in the oil solvent, and the obtained solution is dispersed together with an ionic surfactant and/or a polymer electrolyte in water using a dispersing device such as a homogenizer, to thereby disperse the droplets of the solvent solution (i.e. the crystalline organic fine particles). Thereafter, the oil solvent is evaporated to prepare a dispersion liquid in which the crystalline organic fine particles are dispersed with assistance of the ionic surfactant. In the case where the polyester resin has high acid value, the polyester resin contains a functional group which may become an anionic group by neutralization, to thereby have self-water dispersibility. Namely, a functional group which may become a hydrophilic group is partly or entirely neutralized with base, so that a stable aqueous dispersion can be formed in an action of the aqueous medium. The functional group which can be a hydrophilic group by neutralization of the polyester resin is an acidic group such as a carboxyl group, and a sulfone group. Examples of the neutralizing agents include inorganic bases such as sodium hydroxide, potassium hydroxide, lithium hydroxide, calcium hydroxide, sodium carbonate, and ammonia; and organic bases such as diethylamine, triethylamine, and isopropylamine.

Moreover, in the case where the polyester resin itself is not dispersible, namely, the polyester resin having no self-water dispersibility is used, the polyester resin is dispersed with a polymer electrolyte, such as ionic surfactant, polymer acid, polymer base, in a resin solution and/or an aqueous medium to be mixed with the resin solution, and heated higher than the melting point of the polyester resin, and then treated by applying high shearing force using a homogenizer, a pressure discharging device, or the like, to thereby easily obtain the crystalline organic fine particles in a size of 1 μm or smaller. The ionic surfactant or the polymer electrolyte to be used suitably has a concentration of about 0.5% by mass to about 5% by mass in the aqueous medium.

As a device for mixing the polyester resin with an aqueous medium and emulsifying and dispersing the mixture, a continuous emulsification dispersing device may be used. Examples thereof include Homomixer (Tokushu Kika Kogyo Co., LTD), Slusher (Mitsui Mining Co., LTD), Cavitron (Eurotech, LTD), Micro Fluidizer (Mizuho Industrial Co., LTD), Manton Gaulin Homogenizer (APV Gaulin Inc.), Nanomizer (Nanomizer Corp.), and Static Mixer (Noritake Company).

As the particle diameter of each crystalline organic fine particle, the average particle diameter of primary particles thereof is 20 nm to 500 nm, preferably 50 nm to 300 nm, in order to control the particle diameter and particle size distribution of the emulsified particles. The particle diameter may be measured through a scanning electron microscope SEM, or TEM, or by light-scattering method. The particle diameter thereof is preferably measured in such a manner that the crystalline organic fine particles are diluted to a suitable concentration, so as to be within a measurement range, followed by measuring by a laser scattering method using LA-920, manufactured by HORIBA, Ltd. In this way, the volume average particle diameter thereof is obtained.

Examples of anionic surfactants used in the method for producing a toner of the present invention include alkylbenzene sulfonic acid salts, α-olefin sulfonic acid salts, phosphates, and anionic surfactants having a fluoroalkyl group. Examples of the anionic surfactants having a fluoroalkyl group include fluoroalkyl carboxylic acids having 2 to 10 carbon atoms or metal salts thereof, disodium perfluorooctanesulfonylglutamate, sodium-3-[ω-fluoroalkyl (C6 to C11) oxy]-1-alkyl (C3 to C4) sulfonate, sodium-3-[ω-fluoroalkanoyl (C6 to C8)-N-ethylamino]-1-propanesulfonate, fluoroalkyl (C11 to C20) carboxylic acids or metal salts thereof, perfluoroalkyl (C7 to C13) carboxylic acids or metal salts thereof, perfluoroalkyl (C4 to C12) sulfonic acid or metal salts thereof, perfluorooctanesulfonic acid diethanol amide, N-propyl-N-(2-hydroxyethyl)perfluorooctanesulfone amide, perfluoroalkyl (C6 to C10) sulfoneamidepropyltrimethylammonium salts, perfluoroalkyl (C6 to C10)-N-ethylsulfonyl glycin salts, and monoperfluoroalkyl(C6 to C16) ethylphosphate ester.

Examples of commercially available products of the fluoroalkyl group-containing anionic surfactants include, but not limited to, SURFLON S-111, S-112 and S-113 (manufactured by Asahi Glass Co., Ltd.); FLUORAD FC-93, FC-95, FC-98 and FC-129 (manufactured by Sumitomo 3M Limited); UNIDYNE DS-101 and DS-102 (manufactured by Daikin Industries, Ltd.); MEGAFACE F-110, F-120, F-113, F-191, F-812 and F-833 (manufactured by Dainippon Ink and Chemicals, Incorporated); EETOP EF-102, 103, 104, 105, 112, 123A, 123B, 306A, 501, 201 and 204 (manufactured by Tohchem Products Co., Ltd.); FTERGENT F-100 and F-150 (manufactured by NEOS COMPANY LIMITED).

Moreover, sodium dodecyldiphenyl ether sulfonate, and the like are preferable, because of its easy-availability at low cost, and no problem in safety.

<Binder Resin>

The binder resin used in the method for producing a toner of the present invention is not particularly limited and may be appropriately selected depending on the intended purpose. At least two or more types of resins are preferably used. Specific examples thereof include known binder resins, such as polyester resins, silicone resins, styrene-acrylic resins, styrene resins, acrylic resins, epoxy resins, diene resins, phenol resins, terpene resins, coumarin resins, amide imide resins, butyral resins, urethane resins, and ethylene vinyl acetate resins.

Of these, polyester resins are particularly preferable because of being sharply melted upon fixing, being capable of smoothing an image surface, having sufficient flexibility even if the molecular weight thereof is lowered. The polyester resins may be used in combination with another resin.

The polyester resins used in the present invention are preferably produced through reaction between one or more polyols represented by the following General Formula (1) and one or more polycarboxylic acids represented by the following General Formula (2):

$$A\text{-}(OH)m \qquad \text{General Formula (1)}$$

in General Formula (1), A represents an alkyl group having 1 to 20 carbon atoms, an alkylene group having 1 to 20 carbon atoms, an aromatic group which may have a substituent, or a heterocyclic aromatic group which may have a substituent; and m is an integer of 2 to 4, $$B\text{—}(COOH)n \qquad \text{General Formula (2)}$$

in General Formula (2), B represents an alkyl group having 1 to 20 carbon atoms, an alkylene group having 1 to 20 carbon atoms, an aromatic group which may have a substituent, or a heterocyclic aromatic group which may have a substituent; and n is an integer of 2 to 4.

The polyols represented by General Formula (1) is not particularly limited and may be appropriately selected depending on the intended purpose. Examples of the polyols represented by General Formula (1) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adducts of bisphenol A, propylene oxide adducts of bisphenol A, hydrogenated bisphenol A, ethylene oxide adducts of hydrogenated bisphenol A, and propylene oxide adducts of hydrogenated bisphenol A.

The polycarboxylic acids represented by General Formula (2) is not particularly limited and may be appropriately selected depending on the intended purpose. Examples of the polycarboxylic acids represented by General Formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Enpol trimer acid, cyclohexane dicarboxylic acid, cyclohexenedicarboxylic acid, butanetetracarboxylic acid, diphenylsulfonetetracarboxylic acid, and ethylene glycolbis (trimellitic acid).

<<Active Hydrogen Group-Containing Compound>>

By incorporating in the toner material used in the present invention, the active hydrogen group-containing compound and a modified polyester resin reactive with the active hydrogen group-containing compound, the mechanical strength of the resultant toner is increased and embedding of the crystalline organic fine particles and external additives can be suppressed. When the active hydrogen group-containing compound has a cationic polarity, it can electrostatically pull the crystalline organic fine particles.

Further, the fluidity of the toner during the heat fixation can be regulated, and consequently, the fixing temperature range can be broadened. Notably, the active hydrogen group-containing compound and the modified polyester resin reactive with the active hydrogen group-containing compound can be said to be a binder resin precursor.

The active hydrogen group-containing compound serves, in the aqueous medium, as an elongating agent, a crosslinking agent, etc. for reactions of elongation, crosslinking, etc. of a polymer reactive with the active hydrogen group-containing compound. The active hydrogen group-containing compound is not particularly limited and may be appropriately selected depending on the intended purpose, as long as it contains an active hydrogen group. For example, when the polymer reactive with the active hydrogen group-containing compound is an isocyanate group-containing polyester prepolymer (A), an amine (B) is preferably used as the active hydrogen group-containing compound, since it can provide a high-molecular-weight product through reactions of elongation, crosslinking, etc. with the isocyanate group-containing polyester prepolymer (A).

The active hydrogen group is not particularly limited and may be appropriately selected depending on the intended purpose, as long as it contains an active hydrogen atom. Examples thereof include a hydroxyl group (alcoholic or phenolic hydroxyl group), an amino group, a carboxylic group and a mercapto group. These may be used alone or in combination. Of these, an alcoholic hydroxyl group is particularly preferable.

The amine (B) is not particularly limited and may be appropriately selected depending on the intended purpose. Examples thereof include diamines (B1), trivalent or higher polyamines (B2), amino alcohols (B3), aminomercaptans (B4), amino acids (B5), and amino-blocked products (B6) of the amines (B1) to (B5). These may be used alone or in combination. Among these, preferred are diamines (B1) and a mixture of the diamines (B1) and a small amount of the trivalent or higher polyamines (B2).

Examples of the diamines (B1) include aromatic diamines, alicyclic diamines and aliphatic diamines. Examples of the aromatic diamines include phenylenediamine, diethyltoluenediamine and 4,4'-diaminodiphenylmethane. Examples of the alicyclic diamines include 4,4'-diamino-3,3'-dimethyldicyclohexylmethane, diaminecyclohexane and isophoronediamine. Examples of the aliphatic diamines include ethylenediamine, tetramethylenediamine and hexamethylenediamine.

Examples of the trivalent or higher polyamines (B2) include diethylenetriamine and triethylenetetramine. Examples of the amino alcohols (B3) include ethanolamine and hydroxyethylaniline. Examples of the aminomercaptans (B4) include aminoethyl mercaptan and aminopropyl mercaptan. Examples of the amino acids (B5) include aminopropionic acid and aminocaproic acid.

Examples of the amino-blocked products (B6) include ketimine compounds and oxazolidine compounds derived from the amines (B1) to (B5) and ketones, e.g., acetone, methyl ethyl ketone and methyl isobutyl ketone.

Also, a reaction terminator is used for terminating elongation reaction, etc. crosslinking reaction between the active hydrogen group-containing compound and the polymer reactive therewith. Use of the reaction terminator can control the adhesive base material in its molecular weight, etc. to a desired range. The reaction terminator is not particularly limited, and examples thereof include monoamines and blocked products thereof, e.g., ketimine compounds. Examples of the monoamines include diethyl amine, dibutyl amine, butyl amine and lauryl amine.

The mixing ratio of the isocyanate group-containing polyester prepolymer (A) to the amine (B) is preferably 1/3 to 3/1, more preferably 1/2 to 2/1, particularly preferably 1/1.5 to 1.5/1, in terms of the equivalent ratio ([NCO]/[NHx]) of the isocyanate group [NCO] in the isocyanate group-containing prepolymer (A) to the amino group [NHx] in the amine (B). When the equivalent ratio ([NCO]/[NHx]) is less than 1/3, the formed toner may have degraded low temperature fixing ability. When the equivalent ratio ([NCO]/[NHx]) is more than 3/1, the molecular weight of the urea-modified polyester resin decreases, and the formed toner may have degraded hot offset resistance.

<<Polymer Reactive with Active Hydrogen Group-Containing Compound>>

The polymer reactive with the active hydrogen group-containing compound (hereinafter also referred to as a "prepolymer") is not particularly limited and may be appropriately selected from known resins depending on the intended purpose, as long as it has at least a site reactive with the active hydrogen group-containing compound. Examples thereof include polyol resins, polyacrylic resins, polyester resins, epoxy resins, and derivative resins thereof. Of these, polyester resins are particularly preferred since they have high fluidity upon melting and high transparency. These may be used alone or in combination.

In the prepolymer, the site reactive with the active hydrogen group-containing group is not particularly limited and may be appropriately selected from known substituents (moieties). Examples thereof include an isocyanate group, an epoxy group, a carboxyl group and an acid chloride group. These may be used alone or in combination as the reaction site. Of these, an isocyanate group is particularly preferred. As the prepolymer, a urea bond-forming group-containing polyester resin (RMPE) is particularly preferred, since it is easily adjusted for the molecular weight of the polymeric component thereof, and for assuring oil-less low temperature fixing ability, particularly, excellent releasing and fixing properties of a dry toner, in the case there is no releasing oil-application mechanism for a heating medium for fixation.

Examples of the urea bond-forming group include an isocyanate group. In the case where in the urea bond-forming group-containing polyester resin RMPE the urea bond-forming group is the isocyanate group, an isocyanate group-containing polyester prepolymer (A) is particularly preferable as the polyester resin RMPE. The isocyanate group-containing polyester prepolymer (A) is not particularly limited and may be appropriately selected depending on the intended purpose. Examples thereof include those produced as follows: polyol (PO) is polycondensed with polycarboxylic acid (PC) to form an active hydrogen group-containing polyester resin; and the thus-formed polyester resin is reacted with polyisocyanate (PIC). The polyol (PO) is not particularly limited and may be appropriately selected depending on the intended purpose.

Examples thereof include diols (DIOs), trihydric or higher polyols (TOs), and mixtures of diols (DIOs) and trihydric or higher polyols (TOs). These may be used alone or in combination. Of these, preferred are diols (DIOs) and mixtures of diols (DIOs) and a small amount of trihydric or higher polyols (TOs). Examples of the diol (DIO) include alkylene glycols, alkylene ether glycols, alicyclic diols, alkylene oxide adducts of alicyclic diols, bisphenols, and alkylene oxide adducts of bisphenols.

The alkylene glycols are preferably those having 2 to 12 carbon atoms, and examples thereof include ethylene glycol, 1,2-propylene glycol, 1,3-propylene glycol, 1,4-butanediol and 1,6-hexanediol. Examples of the alkylene ether glycols include diethylene glycol, triethylene glycol, dipropylene glycol, polyethylene glycol, polypropylene glycol and polytetramethylene ether glycol. Examples of the alicyclic diols include 1,4-cyclohexane dimethanol and hydrogenated bisphenol A. Examples of the alkylene oxide adducts of alicyclic diols include adducts of the alicyclic diols with alkylene oxides, e.g., ethylene oxides, propylene oxides and butylene oxides. Examples of the bisphenols include bisphenol A, bisphenol F and bisphenol S. Examples of the alkylene oxide adducts of bisphenols include adducts of the bisphenols with alkylene oxides, e.g., ethylene oxides, propylene oxides and butylene oxides. Of these, preferred are alkylene glycols having 2 to 12 carbon atoms and alkylene oxide adducts of bisphenols, particularly preferred are alkylene oxide adducts of bisphenols, and mixtures of alkylene glycols having 2 to 12 carbon atoms and alkylene oxide adducts of bisphenols.

As the trihydric or higher polyol (TO) tri- to octa-hydric polyols are preferably used. Examples thereof include trihydric or higher aliphatic alcohols, and trihydric or higher polyphenols, and alkylene oxide adducts of the trihydric or higher polyphenols. Examples of the trihydric or higher aliphatic alcohols include glycerin, trimethylolethane, trimethylolpropane, pentaerythritol and sorbitol. Examples of the trihydric or higher polyphenols include trisphenol compounds (e.g., trisphenol PA, manufactured by HONSHU CHEMICAL INDUSTRY CO., LTD.), phenol novolac and cresol novolac. Examples of the alkylene oxide adducts of the trihydric or higher polyphenols include adducts of the trihydric or higher polyphenols with alkylene oxides, e.g., ethylene oxides, propylene oxides and butylene oxides.

In the mixture of the diol (DIO) and the trihydric or higher polyol (TO), the mixing ratio by mass (DIO/TO) is preferably 100/0.01 to 100/10, more preferably 100/0.01 to 100/1.

The polycarboxylic acid (PC) is not particularly limited and may be appropriately selected depending on the intended purpose. Examples thereof include dicarboxylic acids (DICs), tri- or higher polycarboxylic acids (TCs), and mixtures of dicarboxylic acids (DICs) and the tri- or higher polycarboxylic acids (TCs). These may be used alone or in combination. Of these, preferred are dicarboxylic acids (DICs) alone and mixtures of DICs and a small amount of tri- or higher polycarboxylic acids (TCs).

Examples of the dicarboxylic acid (DIC) include alkylene dicarboxylic acids, alkenylene dicarboxylic acids, and aromatic dicarboxylic acids. Examples of the alkylene dicarboxylic acid include succinic acid, adipic acid and sebacic acid. The alkenylene dicarboxylic acid is preferably those having 4 to 20 carbon atoms, and examples thereof include maleic acid and fumaric acid. The aromatic dicarboxylic acid is preferably those having 8 to 20 carbon atoms, and examples thereof include phthalic acid, isophthalic acid, terephthalic acid, and naphthalenedicarboxylic acid. Of these, preferred are alkenylene dicarboxylic acids having 4 to 20 carbon atoms and aromatic dicarboxylic acids having 8 to 20 carbon atoms.

As the tri- or higher polycarboxylic acid (TC), tri- to octa-carboxylic acids are preferable. Examples of the tri- or higher polycarboxylic acid include aromatic polycarboxylic acids. The aromatic polycarboxylic acid is preferably those having 9 to 20 carbon atoms, and examples thereof include trimellitic acid and pyromellitic acid.

As the polycarboxylic acid (PC), there may be used acid anhydrides or lower alkyl esters of the dicarboxylic acids (DICs), the tri- or higher polycarboxylic acids (TCs), or mixtures of the dicarboxylic acids (DICs) and the tri- or higher polycarboxylic acids. Examples of the lower alkyl esters thereof include methyl esters thereof, ethyl esters thereof and isopropyl esters thereof.

In the mixture of the dicarboxylic acid (DIC) and the tri- or higher polycarboxylic acid (TC), the mixing ratio by mass (DIC/TC) is not particularly limited and may be appropriately selected depending on the intended purpose. Preferably, the mixing ratio (DIC/TC) is 100/0.01 to 100/10, more preferably 100/0.01 to 100/1.

In polycondensation reaction between the polyol (PO) and the polycarboxylic acid (PC), the mixing ratio of PO to PC is not particularly limited and may be appropriately selected depending on the intended purpose. The mixing ratio PO/PC is preferably 2/1 to 1/1, more preferably 1.5/1 to 1/1, particularly preferably 1.3/1 to 1.02/1, in terms of the equivalent ratio ([OH]/[COOH]) of hydroxyl group [OH] in the polyol (PO) to carboxyl group [COOH] in the polycarboxylic acid (PC).

The content of the polyol (PO) in the isocyanate group-containing polyester prepolymer (A) is not particularly limited and may be appropriately selected depending on the intended purpose. For example, it is preferably 0.5% by mass to 40% by mass, more preferably 1% by mass to 30% by mass, particularly preferably 2% by mass to 20% by mass. When the content of the polyol (PO) is less than 0.5% by mass, the formed toner has degraded hot offset resistance, and it becomes difficult to attain both desired heat-resistant storage stability and desired low temperature fixing ability of the toner. When the content of the polyol (PO) is more than 40% by mass, the formed toner may have degraded low temperature fixing ability.

The polyisocyanate (PIC) is not particularly limited and may be appropriately selected depending on the intended purpose. Examples thereof include aliphatic polyisocyanates, alicyclic polyisocyanates, aromatic diisocyanates, aromatic/aliphatic diisocyanates, isocyanurates, phenol derivatives thereof, and blocked products thereof with oxime, caprolactam. Examples of the aliphatic polyisocyanates include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate, and tetramethylhexane diisocyanate. Examples of the alicyclic polyisocyanates include isophorone diisocyanate and cyclohexylmethane diisocyanate. Examples of the aromatic diisocyanates include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenylether-4,4'-diisocyanate. Examples of the aromatic/aliphatic diisocyanates include $\alpha,\alpha,\alpha',\alpha'$-tetramethylxylylene diisocyanate. Examples of the isocyanurates include tris-isocyanatoalkyl-isocyanurate and triisocyanatocycloalkyl-isocyanurate. These may be used alone or in combination.

In reaction between the polyisocyanate (PIC) and the active hydrogen group-containing polyester resin, e.g., hydroxyl group-containing polyester resin, the ratio of the PIC to the hydroxyl group-containing polyester resin is preferably 5/1 to 1/1, more preferably 4/1 to 1.2/1, particularly preferably 3/1 to 1.5/1, in terms of the mixing equivalent ratio ([NCO]/[OH]) of an isocyanate group [NCO] in the polyisocyanate (PIC) to a hydroxyl group [OH] in the hydroxyl group-containing polyester resin. When the [NCO] in the mixing equivalent ratio [NCO]/[OH] is more than 5/1, the formed toner may have degraded low temperature fixing ability. When the [NCO] in the mixing equivalent ratio [NCO]/[OH] is less than 1/1, the formed toner may have degraded offset resistance.

The content of the polyisocyanate (PIC) in the isocyanate group-containing polyester prepolymer (A) is not particularly limited and may be appropriately selected depending on the intended purpose. For example, it is preferably 0.5% by mass to 40% by mass, more preferably 1% by mass to 30% by mass, still more preferably 2% by mass to 20% by mass. When the content of the polyisocyanate (PIC) is less than 0.5% by mass, the formed toner may have degraded hot offset resistance, and it becomes difficult to attain both desired heat-resistant storage stability and desired low temperature fixing ability. When the content of the polyisocyanate (PIC) is more than 40% by mass, the formed toner may have degraded low temperature fixing ability of the toner.

The average number of isocyanate groups per molecule of the isocyanate group-containing polyester prepolymer (A) is not particularly limited but is preferably one or more, more preferably 1.2 to 5, still more preferably 1.5 to 4. When the average number of the isocyanate groups is less than one per one molecule, the molecular weight of the polyester resin modified with a urea bond-forming group (RMPE) decreases, and the formed toner may have degraded hot offset resistance.

The weight average molecular weight Mw of the polymer reactive with the active hydrogen group-containing compound is not particularly limited but is preferably 3,000 to 40,000, more preferably 4,000 to 30,000 based on the molecular weight distribution obtained by analyzing tetrahydrofuran (THF) soluble matter of the polymer through gel permeation chromatography (GPC). When the weight average molecular weight Mw is lower than 3,000, the formed toner may have degraded heat-resistant storage stability. When the Mw is higher than 40,000, the formed toner may have degraded low temperature fixing ability.

The molecular weight distribution by gel permeation chromatography (GPC) may be measured in the following manner.

First, a column is stabilized in a heat chamber set at 40° C. At this temperature, tetrahydrofuran as a column solvent is poured at a flow rate of 1 mL/min, and 50 μL to 200 μL of a tetrahydrofuran solution with the concentration of a sample being adjusted to 0.05% by mass to 0.6% by mass, followed by carrying out the measurement. The molecular weight is calculated based upon the relationship between count numbers and logarithmic values of a calibration curve produced using several types of standard samples. As the standard samples for producing the calibration curve, monodisperse polystyrenes, manufactured by Pressure Chemical Company or Toyo Soda Manufacturing Co., Ltd., having molecular weights of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ respectively may be used. On this occasion, it is preferable to use standard samples of 10 types or so. A refractive index detector may be employed as a detector.

<Colorant>

The colorant used in the toner of the present invention is not particularly limited and may be appropriately selected from known dyes and pigments depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone. These colorants may be used alone or in combination.

The amount of the colorant contained in the toner is not particularly limited and may be appropriately determined depending on the intended purpose. It is preferably 1% by mass to 15% by mass, more preferably 3% by mass to 10% by mass. When the amount of the colorant is less than 1% by mass, the formed toner may degrade in coloring performance. When the amount is more than 15% by mass, the pigment is not sufficiently dispersed in the toner, possibly causing decrease in coloring performance and in electrical properties of the formed toner.

The colorant may be mixed with a resin to form a masterbatch. The resin is not particularly limited and may be appropriately selected from those known in the art. Examples thereof include polyesters, polymers of styrene or substituted styrene, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acid resins, rosin, modified rosins, terpene resins, aliphatic or alicyclic hydrocarbon resins, aromatic petroleum resins, chlorinated paraffins and paraffin waxes. These resins may be used alone or in combination.

Examples of the polymers of styrene or substituted styrene include polyesters, polystyrenes, poly(p-chlorostyrenes) and polyvinyltoluenes. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be prepared by mixing or kneading a colorant with the resin for use in the masterbatch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, for example, a high-shearing disperser, e.g., a three-roll mill is preferably used. When two resins having different polarities are used as the resin for producing toner base particles, the colorant may be incorporated into any of the first resin phase and the second resin phase by utilizing the difference in affinity to the two resins. As has been known well, when exists in the surface of the toner particle, the colorant degrades charging performance of the toner. Thus, by selectively incorporating the colorant into the first resin phase which is the inner layer, the formed toner can be improved in charging performances (e.g., environmental stability, charge retainability and charging amount).

<Other Components>

Other components of the toner are not particularly limited and may be appropriately selected depending on the intended purpose. Examples thereof include a releasing agent, a charge controlling agent, inorganic fine particles, a flowability improver, a cleanability improver, a magnetic material, and a metal soap.

<<Releasing Agent>>

The releasing agent is not particularly limited and may be appropriately selected depending on the intended purpose. The melting point thereof is preferably low; i.e., 50° C. to 120° C. When dispersed together with a resin, such a low-melting-point releasing agent effectively exhibits its releasing effects on the interface between a fixing roller and each toner particle. Thus, even when an oil-less mechanism is employed (in which a releasing agent such as oil is not applied onto a fixing roller), excellent hot offset resistance is attained.

Preferred examples of the releasing agent include waxes. Examples of the waxes include natural waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum); synthetic hydrocarbon waxes (e.g., Fischer-Tropsch waxes and polyethylene waxes); and synthetic waxes (e.g., ester waxes, ketone waxes and ether waxes). Further examples include fatty acid amides such as 12-hydroxystearic acid amide, stearic amide, phthalic anhydride imide and chlorinated hydrocarbons; low-molecular-weight crystalline polymer resins such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain. These releasing agents may be used alone or in combination.

The melting point of the releasing agent is not particularly limited and may be appropriately selected depending on the intended purpose. The melting point is preferably 50° C. to 120° C., more preferably 60° C. to 90° C. When the melting point is lower than 50° C., the wax may adversely affect the heat-resistant storage stability of the toner. When the melting point is higher than 120° C., cold offset is easily caused upon fixing at lower temperatures. The melt viscosity of the releasing agent is not particularly limited and may be appropriately selected depending on the intended purpose. In the case where the melt viscosity of the releasing agent is measured at the temperature 20° C. higher than the melting point of the wax, it is preferably 5 cps to 1,000 cps, more preferably 10 cps to 100 cps. When the melt viscosity is lower than 5 cps, the formed toner may degrade in releasing ability. When the melt viscosity is higher than 1,000 cps, the hot offset resistance and the low temperature fixing ability may not be improved. The amount of the releasing agent contained in the toner is not particularly limited and may be appropriately selected depending on the intended purpose. The amount of the releasing agent is preferably 0% by mass to 40% by mass, more preferably 3% by mass to 30% by mass. When the amount is higher than 40% by mass, the formed toner may be degraded in flowability.

When two resins having different polarities are used as the resin for producing toner base particles, the releasing agent may be incorporated into any of the first resin phase and the second resin phase by utilizing the difference in affinity to the two resins. By selectively incorporating the releasing agent into the second resin phase which is the outer layer of the toner, the releasing agent oozes out satisfactorily in a short heating time upon fixation, and consequently, satisfactory releasability can be realized. On the other hand, by selectively incorporating the releasing agent into the first resin phase which is the inner layer, the spent of the releasing agent to other members such as the photoconductors and carriers can be suppressed. In the present invention, the arrangement of the releasing agent is sometimes relatively freely designed and the releasing agent may be arbitrarily arranged according to various image forming processes.

<<Charge Controlling Agent>>

The charge controlling agent is not particularly limited and may be appropriately selected from those known in the art. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives. These may be used alone or in combination.

Also, the charge controlling agent may be a commercially available product. Examples thereof include nigrosine dye BONTRON 03, quaternary ammonium salt BONTRON P-51, metal azo-containing dye BONTRON S-34, oxynaphthoic acid-based metal complex E-82, salicylic acid-based metal complex E-84 and phenol condensate E-89 (manufactured by ORIENT CHEMICAL INDUSTRIES CO., LTD); quaternary ammonium salt molybdenum complex TP-302 and TP-415 (manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (manufactured by Hoechst AG); LRA-901, boron complex and LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The charge controlling agent may be incorporated into any of a resin phase inside the toner base particles and a resin phase of the crystalline organic fine particles by utilizing the difference in affinity to the resin in the toner base particle and the resin of the crystalline organic fine particles. By selectively incorporating the charge controlling agent into the resin phase of the crystalline organic fine particles which are present in the toner surface, charging effect can be easily obtained by a small amount of the charge controlling agent. On the other hand, when the charge controlling agent is selectively contained in the resin phase inside the toner base particles present in the inner layer, the spent of the charge controlling agent to other members such as the photoconductors and carriers can be suppressed. In the method for producing a toner of the present invention, the arrangement of the charge controlling agent is sometimes relatively freely designed and the charge controlling agent may be arbitrarily arranged according to various image forming processes.

The amount of the charge controlling agent in the toner varies depending upon the type of the binder resin used, the presence or absence of an additive, the dispersing process employed, etc. and therefore cannot be unequivocally defined. Nevertheless, the amount of the charge controlling agent is preferably 0.1% by mass to 10% by mass, more preferably 0.2% by mass to 5% by mass, relative to 100% by mass of the binder resin. When the amount of the charge controlling agent is less than 0.1% by mass, favorable charge controlling properties may not be obtained. When the amount thereof is greater than 10% by mass, the charging ability of the toner is excessively increased, and the effect of the charge controlling agent is decreased, and the electrostatic attraction between the toner and a developing sleeve increases, possibly causing degradation of the fluidity of the developer and a decrease in image density.

<<Inorganic Fine Particles>>

The inorganic fine particles are used as an external additive for imparting, for example, fluidity, developability and charging ability to the toner particles. The inorganic fine particles are not particularly limited and may be appropriately selected from those known in the art depending on the intended purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These inorganic fine particles may be used alone or in combination.

In addition to inorganic fine particles having a large particle diameter of 80 nm to 500 nm in terms of primary average particle diameter, inorganic fine particles having a small particle diameter can be preferably used as inorganic fine particles for assisting the fluidity, develop ability, and charging ability of the toner. In particular, hydrophobic silica and hydrophobic titanium oxide are preferably used as the inorganic fine particles having a small particle diameter. The primary average particle diameter of the inorganic fine particles is preferably 5 nm to 50 nm, more preferably 10 nm to 30 nm. The BET specific surface area of the inorganic fine particles is preferably 20 $m^2/g$ to 500 $m^2/g$. The amount of the inorganic fine particles contained in the toner is preferably 0.01% by mass to 5% by mass, more preferably 0.01% by mass to 2% by mass.

<<Flowability Improver>>

The flowability improver is an agent for performing surface treatment to improve hydrophobic properties, and is capable of preventing the degradation of flowability or charging ability under high humidity environment. Specific examples of the flowability improver include silane coupling agents, silylation agents, silane coupling agents having a fluorinated alkyl group, organotitanate coupling agents, aluminum coupling agents, silicone oils, and modified silicone oils. It is preferable that the silica and titanium oxide be subjected to surface treatment with such a flowability improver and used as hydrophobic silica and hydrophobic titanium oxide.

<<Cleanability Improver>>

The cleanability improver is an agent added to the toner to remove the developer remaining on a photoconductor or a primary transfer medium after transfer. Specific examples of the cleanability improver include metal salts of fatty acids such as stearic acid (e.g., zinc stearate and calcium stearate), polymer fine particles formed by soap-free emulsion polymerization, such as polymethylmethacrylate fine particles and polystyrene fine particles. The polymer fine particles preferably have a relatively narrow particle size distribution. It is preferable that the volume average particle diameter thereof be 0.01 μm to 1 μm.

<<Magnetic Material>>

The magnetic material is not particularly limited and may be appropriately selected from those known in the art depending on the intended purpose. Examples thereof include iron powder, magnetite and ferrite. Of these, one having a white color is preferable in terms of color tone.

<Detail of Method for Producing Toner of the Present Invention>

<<Suspension Polymerization Process>>

In the method for producing an electrophotographic toner of the present invention, in the case where the suspension polymerization process is used, the toner base particle forming step includes emulsifying or dispersing the solution or dispersion of the toner material which contains at least a polymerizable monomer as the binder resin precursor and the colorant in the aqueous medium, so as to form an emulsion or dispersion liquid; and allowing a polymerization reaction to undergo in the emulsion or dispersion liquid.

An embodiment of the suspension polymerization process is that, an oil soluble polymerization initiator is used, the colorant, a releasing agent and the like are dispersed in the polymerizable monomer, emulsion or dispersion is performed in the aqueous medium containing a surfactant and other solid dispersant or the like by an emulsification method which will be described below, and a polymerization reaction is then allowed to proceed to prepare particles. Thereafter, onto the particles the crystalline organic fine particles are treated to adhere. The toner base particle is preferably subjected to adhesion treatment after the excessive amount of the surfactant on the toner base particle is removed by washing. A functional group can be introduced into a surface of the toner base particle using the polymerizable monomer. The polymerizable monomer is not particularly limited as long as it can form a toner, and may be appropriately selected depending on the intended purpose. Examples thereof include acids such as acrylic acid, methacrylic acid, α-cyanoacrylic acid, α-cyanomethacrylic acid, itaconic acid, crotonic acid, fumaric acid, maleic acid, and maleic anhydride; acryl amide, methacryl amide, diacetone acryl amide acid, and methylol compounds thereof, vinyl pyridine, vinyl pyrrolidone, vinyl imidazole, and ethylene imine; acrylate, methacrylate having an amino group such as dimethylaminoethyl methacrylate. As the dispersant to be used, the dispersant having acid a group or basic group is selected to adsorb to and remain on the surface of the toner base particle, to thereby introduce a functional group into the surface thereof.

<<Emulsion Polymerization Coagulation Process>>

In the method for producing an electrophotographic toner of the present invention, in the case where the emulsion polymerization coagulation process is used, the toner base particle forming step includes dispersing the dispersion of the toner material containing at least a polymerizable monomer as the binder resin precursor and the colorant in the aqueous medium; aggregating the dispersion in the aqueous medium to form aggregates; and heating and fusing the aggregates.

An embodiment of the polymerization coagulation process is as follows. A water soluble polymerization initiator and the polymerizable monomer are emulsified in an aqueous medium with a surfactant, and a latex is synthesized by a conventional emulsion polymerization process. Separately, a dispersion is prepared by dispersing the colorant, a releasing agent, etc. in an aqueous medium, and the latex and the dispersion are mixed and then aggregated to a desired size of the toner base particle, followed by heating and fusing to thereby obtain the toner base particle. Thereafter, the toner base particle is treated in the same manner as the suspension polymerized particles as described above. As the latex, those similar to the polymerizable monomer which can be used for the aforementioned suspension polymerization process are used, to thereby introduce a functional group to the surface of the toner base particle.

In the case where a polymerizable monomer is not used, once a resin is produced by a suitable method, and the obtained resin is emulsified in water, to thereby produce latex. In the case where the resin has a polar group, emulsification is smoothly performed in most cases.

<<Dissolution Suspension Process>>

In the method for producing an electrophotographic toner of the present invention, in the case where the dissolution suspension process is used, the toner base particle forming step includes dissolving or dispersing the toner material containing at least the colorant and any one of the binder resin and the binder resin precursor in an organic solvent, so as to form the solution or dispersion; emulsifying or dispersing the solution or dispersion in the aqueous medium, so as to form an emulsion or dispersion liquid; and removing the organic solvent of the emulsion or dispersion liquid.

As an embodiment, a desired toner is produced by a process including dissolving or dispersing the toner material containing at least the binder resin and the colorant in the organic solvent to form the solution or dispersion, and emulsifying or dispersing the solution or dispersion in the aqueous medium to prepare the emulsion or dispersion liquid, and allowing granulated crystalline organic fine particles to adhere onto the toner precursor containing the emulsified or dispersed toner material.

As another more preferred embodiment, the toner base particle forming step includes dissolving or dispersing the toner material containing at least an active hydrogen group-containing compound and a polymer reactive with the active hydrogen group-containing compound as the binder resin precursors and the colorant in an organic solvent, so as to form the solution or dispersion; emulsifying or dispersing the solution or dispersion in the aqueous medium; subjecting the active hydrogen group-containing compound and the polymer reactive with the active hydrogen group-containing compound to crosslinking or elongation reaction, so as to form an emulsion or dispersion liquid; and removing the organic solvent of the emulsion or dispersion liquid. Thus, the toner base particles containing at least an adhesive base material is formed, and granulated crystalline organic fine particles are attached thereto, so as to form a desired toner.

<<Solution or Dispersion of Toner Material>>

The solution or dispersion of the toner material is prepared by dissolving or dispersing the toner material in a solvent. The toner material is not particularly limited as long as it can form a toner, and may be appropriately selected depending on the intended purpose. For example, the toner material contains an active hydrogen group-containing compound, a polymer (prepolymer) reactive with the active hydrogen group-containing compound, and if necessary, may further contain aforementioned other components, such as an unmodified polyester resin, the releasing agent, the colorant and the charge controlling agent. The solution or dispersion liquid of the toner material is preferably prepared by dissolving or dispersing the toner material in the organic solvent. The organic solvent is preferably removed during or after formation of the toner base particles.

<<Organic Solvent>>

The organic solvent is not particularly limited, as long as it allows the toner material to be dissolved or dispersed therein, and may be appropriately selected depending on the intended purpose. It is preferable that the organic solvent be a solvent having a boiling point of lower than 150° C. in terms of easy removal during or after formation of the toner base particles. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Of these solvents, ester solvents are preferable, and ethyl acetate is particularly preferable. These solvents may be used alone or in combination. The amount of the organic solvent is not particularly limited and may be appropriately selected depending on the intended purpose. The amount of the organic solvent is preferably 40 parts by mass to 300 parts by mass, more preferably 60 parts by mass to 140 parts by mass, still more preferably 80 parts by mass to 120 parts by mass, relative to 100 parts by mass of the toner material.

The preparation of the solution or dispersion liquid of the toner material is performed by dissolving or dispersing in the organic solvent the toner material containing an active hydrogen group-containing compound, a polymer (prepolymer) reactive with the active hydrogen group-containing compound, an unmodified polyester resin, a releasing agent, a colorant and a charge controlling agent. Of the toner material, components other than the polymer (prepolymer) reactive with the active hydrogen group-containing compound may be added and mixed in the aqueous medium in the preparation of the aqueous medium described below, or may be added together with the solution or dispersion in the aqueous medium when the solution or dispersion of the toner material is added to the aqueous medium.

<<Aqueous Medium>>

The aqueous medium is not particularly limited and may be appropriately selected from those known in the art. Examples thereof include water, water-miscible solvents and mixtures thereof. Of these, water is particularly preferred. The water-miscible solvent is not particularly limited, as long as it is miscible with water. Examples thereof include alcohols, dimethylformamide, tetrahydrofuran, cellsolves and lower ketones. Examples of the alcohols include methanol, isopropanol and ethylene glycol. Examples of the lower ketones include acetone and methyl ethyl ketone. These may be used alone or in combination.

The preparation of the aqueous medium can be performed by dispersing the crystalline organic fine particles in the aqueous medium in the presence of an anionic surfactant. The amounts added of the anionic surfactant and the crystalline organic fine particles in the aqueous medium are not particularly limited and may be appropriately selected depending on the intended purpose. For example, the amounts added of the anionic surfactant and the crystalline organic fine particles are preferably respectively 0.5% by mass to 10% by mass.

<<Emulsification or Dispersion>>

The emulsification or dispersion of the solution or dispersion of the toner material in the aqueous medium is preferably performed by dispersing the solution or dispersion liquid in the aqueous medium with stirring. The dispersion method is not particularly limited and may be appropriately selected depending on the intended purpose. For example, known dispersers may be used for dispersion. Examples of the dispersers include low-speed shear dispersers and high-speed shear dispersers. In the method for producing a toner, during the emulsification or dispersion, the active hydrogen group-containing compound and the polymer reactive with the active hydrogen group-containing compound are subjected to elongation reaction or crosslinking reaction, to thereby form an adhesive base material. The crystalline organic fine particles may be added in the aqueous medium during or after emulsification. The crystalline organic fine particles are added either during dispersing them using a high-speed shearing dispersing device or after emulsification using a low speed stirrer replaced from the device, while checking the adhesion and fixation state of the crystalline organic fine particles to the toner base particle. When the adhesion of the crystalline organic fine particles to the toner base particle is low, a known flocculating agent may be used. Examples thereof include metal salts such as calcium chloride, calcium nitrate, barium chloride, magnesium chloride, zinc chloride, aluminum chloride, and aluminum sulfate; inorganic metal salt polymers such as polyaluminum chloride, polyaluminum hydroxide, and calcium polysulfide. Of these, aluminum salts and polymers thereof are preferable. In order to obtain uniform adhesion, as to the valence of inorganic metal salt, divalence is preferable to monovalence, trivalence is preferable to divalence, and tetravalence is preferable to trivalence, as to the type of the inorganic metal salt when the valence is the same, the polymer type, that is the inorganic metal salt polymer, is preferable to the monomer type.

<<Adhesive Base Material>>

The adhesive base material is a base material of the toner obtained from the binder resin and the binder resin precursor, preferably exhibits adhesiveness to a recording medium such as paper, and contains an adhesive polymer obtained through reaction of the active hydrogen group-containing compound with the polymer reactive with the active hydrogen group-containing compound in an aqueous medium. The adhesive base material may contains a binder resin appropriately selected from known resins. The weight average molecular weight of the adhesive base material is not particularly limited and may be appropriately selected depending on the intended purpose. It is preferably 3,000 or higher, more preferably 5,000 to 1,000,000, particularly preferably 7,000 to 500,000. Since the weight average molecular weight is lower than 3,000, the formed toner may have degraded hot offset resistance.

The glass transition temperature Tg of the binder resin is not particularly limited and may be appropriately selected depending on the intended purpose. The glass transition temperature of the binder resin is preferably 30° C. to 70° C., more preferably 40° C. to 65° C. When the glass transition temperature Tg is lower than 30° C., the formed toner may have degraded heat-resistant storage stability. When the glass transition temperature Tg is higher than 70° C., the formed toner may have insufficient low-temperature fixing property. In an exemplary electrophotographic toner of the present embodiment, there exists a polyester resin which has been subjected to crosslinking reaction and elongation reaction. Accordingly, even when the glass transition temperature is lower than that of the conventional polyester toner, better storage stability can be realized as compared with the conventional polyester toner.

The resin for the adhesive base material is not particularly limited and may be appropriately selected depending on the intended purpose. Polyester resins are particularly preferable. The polyester resins are not particularly limited and may be appropriately selected depending on the intended purpose. Urea-modified polyester resins are particularly preferable. The urea-modified polyester resin is obtained by reacting, in the aqueous medium, amines (B) serving as the active hydrogen group-containing compound and an isocyanate group-containing polyester prepolymer (A) serving as the polymer reactive with the active hydrogen group-containing compound. The urea-modified polyester resin may contain a urethane bonding, as well as a urea bonding. In this case, a molar ratio (urea bonding/urethane bonding) of the urea bonding to the urethane bonding is not particularly limited and may be appropriately selected depending on the intended purpose. It is preferably 10/90 to 100/0, more preferably 20/80 to 80/20, particularly preferably 30/70 to 60/40. In the case where the molar ratio of the urea bonding to the urethane bonding is less than 10/90, the formed toner may have degraded hot offset resistance.

Preferred examples of the urea-modified polyester resins include the following.

(1) a mixture of: a urea-modified polyester resin which is obtained by modifying, with isophorone diamine, polyester prepolymer which is obtained by reacting isophorone diisocyanate with a polycondensation product of bisphenol A ethylene oxide (2 mol) adduct and isophthalic acid; and a polycondensation product of bisphenol A ethylene oxide (2 mol) adduct and isophthalic acid.

(2) a mixture of: a urea-modified polyester resin which is obtained by modifying, with isophorone diamine, polyester prepolymer which is obtained by reacting isophorone diisocyanate with a polycondensation product of bisphenol A ethylene oxide (2 mol) adduct and isophthalic acid; and a polycondensation product of bisphenol A ethylene oxide (2 mol) adduct and terephthalic acid.

(3) a mixture of: a urea-modified polyester resin which is obtained by modifying, with isophorone diamine, polyester prepolymer which is obtained by reacting isophorone diisocyanate with a polycondensation product of bisphenol A ethylene oxide (2 mol) adduct, bisphenol A propylene oxide (2 mol) adduct and terephthalic acid; and a polycondensation product of bisphenol A ethylene oxide (2 mol) adduct, bisphenol A propylene oxide (2 mol) adduct and terephthalic acid.

(4) a mixture of: a urea-modified polyester resin which is obtained by modifying, with isophorone diamine, polyester prepolymer which is obtained by reacting isophorone diisocyanate with a polycondensation product of bisphenol A ethylene oxide (2 mol) adduct, bisphenol A propylene oxide (2 mol) adduct and terephthalic acid; and a polycondensation product of bisphenol A propylene oxide (2 mol) adduct and terephthalic acid.

(5) a mixture of: a urea-modified polyester resin which is obtained by modifying, with hexamethylene diamine, polyester prepolymer which is obtained by reacting isophorone diisocyanate with a polycondensation product of bisphenol A ethylene oxide (2 mol) adduct and terephthalic acid; and a polycondensation product of bisphenol A ethylene oxide (2 mol) adduct and terephthalic acid.

(6) a mixture of: a urea-modified polyester resin which is obtained by modifying, with hexamethylene diamine, polyester prepolymer which is obtained by reacting isophorone diisocyanate with a polycondensation product of bisphenol A ethylene oxide (2 mol) adduct and terephthalic acid; and a polycondensation product of bisphenol A ethylene oxide (2 mol) adduct, bisphenol A propylene oxide (2 mol) adduct and terephthalic acid.

(7) a mixture of: a urea-modified polyester resin which is obtained by modifying, with ethylene diamine, polyester prepolymer which is obtained by reacting isophorone diisocyanate with a polycondensation product of bisphenol A ethylene oxide (2 mol) adduct and terephthalic acid; and a polycondensation product of bisphenol A ethylene oxide (2 mol) adduct and terephthalic acid.

(8) a mixture of: a urea-modified polyester resin which is obtained by modifying, with hexamethylene diamine, polyester prepolymer which is obtained by reacting diphenylmethane diisocyanate with a polycondensation product of bisphenol A ethylene oxide (2 mol) adduct and isophthalic acid; and a polycondensation product of bisphenol A ethylene oxide (2 mol) adduct and isophthalic acid.

(9) a mixture of: a urea-modified polyester resin which is obtained by modifying, with hexamethylene diamine, polyester prepolymer which is obtained by reacting diphenylmethane diisocyanate with a polycondensation product of bisphenol A ethylene oxide (2 mol) adduct, bisphenol A propylene oxide (2 mol) adduct, terephthalic acid and dodecenylsuccinic anhydride; and a polycondensation product of bisphenol A ethylene oxide (2 mol) adduct, bisphenol A propylene oxide (2 mol) adduct and terephthalic acid.

(10) a mixture of: a urea-modified polyester resin which is obtained by modifying, with hexamethylene diamine, polyester prepolymer which is obtained by reacting toluene diisocyanate with a polycondensation product of bisphenol A ethylene oxide (2 mol) adduct and isophthalic acid; and a polycondensation product of bisphenol A ethylene oxide (2 mol) adduct and isophthalic acid.

The adhesive base material, e.g., an urea-modified polyester resin is not particularly limited and may be appropriately selected depending on the intended purpose, and is formed by, for example, the following methods.

(1) The solution or dispersion of the toner material containing the polymer reactive with the active hydrogen group-containing compound (e.g., the isocyanate group-containing polyester prepolymer (A)) is emulsified or dispersed in the aqueous medium together with the active hydrogen group-containing compound (e.g., the amine (B)) so as to form oil droplets, and the polymer and the compound are allowed to proceed the elongation reaction and/or crosslinking reaction in the aqueous medium.

(2) The solution or dispersion of the toner material is emulsified or dispersed in the aqueous medium, to which the active hydrogen group-containing compound has previously been added, so as to form oil droplets, and the polymer and the compound are allowed to proceed the elongation reaction and/or crosslinking reaction in the aqueous medium.

(3) The solution or dispersion of the toner material is added and mixed in the aqueous medium, and then the active hydrogen group-containing compound is added thereto so as to form oil droplets, and the polymer and the compound are allowed to proceed the elongation reaction and/or crosslinking reaction from the surfaces of the particles in the aqueous medium. In the case of (3), the modified polyester resin is preferentially formed at the surface of the toner base particle to be formed, and thus the concentration gradation of the modified polyester resin can be provided within the toner base particle.

The reaction conditions for forming the adhesive base material through emulsification or dispersion are not particularly limited and may be appropriately selected depending on the combination of the active hydrogen group-containing compound and the polymer reactive with the active hydrogen group-containing compound. The reaction time is preferably 10 minutes to 40 hours, more preferably 2 hours to 24 hours.

The method for stably forming the dispersion containing the polymer reactive with the active hydrogen group-containing compound, e.g., the isocyanate group-containing polyester prepolymer (A), in the aqueous medium is such that the solution or dispersion liquid of the toner material, which is prepared by dissolving or dispersing in the organic solvent the toner material containing the polymer reactive with the active hydrogen group-containing compound, e.g., the isocyanate group-containing polyester prepolymer (A), the colorant, the releasing agent, the charge controlling agent, the unmodified polyester resin, and the like, is added to the aqueous medium, and then dispersed by shearing force.

In emulsification or dispersion, the amount of the aqueous medium is preferably 50 parts by mass to 2,000 parts by mass, more preferably 100 parts by mass to 1,000 parts by mass, relative to 100 parts by mass of the toner material. When the amount of the aqueous medium used is less than 50 parts by mass, the toner material is poorly dispersed, possibly failing to obtain toner particles having a predetermined particle diameter. When the amount of the aqueous medium used is more than 2,000 parts by mass, the production cost may increase.

The aqueous medium preferably contains anionic surfactants and crystalline organic fine particles, and further contains the following inorganic compound dispersants and polymer protective colloids. The sparingly water soluble inorganic compound dispersants are not particularly limited and may be appropriately selected depending on the intended purpose. Examples thereof include tricalcium phosphate, calcium carbonate, titanium oxide, colloidal silica, and hydroxyapatite.

Examples of the polymer protective colloids include acids, (meth)acrylic monomers having a hydroxyl group, vinyl alcohols or ethers of vinyl alcohols, esters of vinyl alcohol and compounds having a carboxyl group, amide compounds or methylol compounds thereof, chlorides, homopolymers or copolymers of a compound containing a nitrogen atom or a nitrogen-containing heterocyclic ring, polyoxyethylene, and celluloses. Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the (meth)acrylic monomers having a hydroxyl group include β-hydroxyethyl acrylate, β-hydroxylethyl methacrylate, β-hydroxylpropyl acrylate, β-hydroxylpropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, and N-methylolmethacrylamide.

Examples of the vinyl alcohols or ethers of vinyl alcohols include vinyl methyl ether, vinyl ethyl ether, and vinyl propyl ether. Examples of the esters of vinyl alcohols and compounds having a carboxyl group include vinyl acetate, vinyl propionate, and vinyl butyrate. Examples of the amide compounds or methylol compounds thereof include acryl amide, methacryl amide, diacetone acryl amide acid, and methylol compounds thereof.

Examples of the chlorides include acrylic acid chloride, and methacrylic acid chloride. Examples of the homopolymers or copolymers of a compound containing a nitrogen atom or a nitrogen-containing heterocyclic ring include vinyl pyridine, vinyl pyrrolidone, vinyl imidazole, and ethylene imine.

Examples of the polyoxy ethylenes include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester. Examples of the cellulose include methyl cellulose, hydroxyethyl cellulose, and hydroxypropyl cellulose.

When a dispersion stabilizer (e.g., calcium phosphate) soluble in an acid or alkalis is used, the calcium phosphate can be removed from fine particles by dissolving it with an acid such as hydrochloric acid, followed by washing with water; or by enzymatically decomposing it.

<<Removal of Organic Solvent>>

The organic solvent is removed from emulsified slurry obtained by emulsification or dispersion. The method for removing the organic solvent is performed as follows: (1) the entire reaction system is gradually increased in temperature to completely evaporate the organic solvent contained in oil droplets; or (2) the emulsified dispersion is sprayed in a dry atmosphere to completely remove, and the water insoluble organic solvent contained in oil droplets to form fine toner base particles, together with evaporating the aqueous dispersant. By removing the organic solvent, toner base particles are formed.

By heating the aqueous dispersion, the formed fine particle layer can be uniformly, more tightly attached to the surface of each toner base particle.

The thus-formed toner particles are subjected to washing, drying, etc., and then, if necessary, to classification, etc. Classification is performed by removing fine particles using a cyclone, a decanter, a centrifugal separator, etc. in the liquid. Alternatively, after drying, the formed powdery toner particles may be classified.

The toner particles produced through the above-described steps may be mixed with, for example, a colorant, a releasing agent and a charge controlling agent, or a mechanical impact may be applied to the resultant mixture (toner particles) for preventing particles of the releasing agent, etc. from dropping off from the surfaces of the toner particles.

Examples of the method for applying a mechanical impact include a method in which an impact is applied to a mixture using a high-speed rotating blade, and a method in which impact is applied by putting mixed particles into a high-speed air flow and accelerating the air speed such that the particles collide with one another or that the particles are crashed into a proper collision plate. Examples of apparatuses used in these methods include ANGMILL (manufactured by Hosokawa Micron Corporation), an apparatus produced by modifying I-type mill (manufactured by Nippon Pneumatic Mfg. Co., Ltd.) so that the pulverizing air pressure thereof is decreased, hybridization system (manufactured by Nara Machinery Co., Ltd.), kryptron system (manufactured by Kawasaki Heavy Industries, Ltd.), and automatic mortar.

<Details of Full-Color Image Forming Method and Full-Color Image Forming Apparatus>

<<Charging Step and Charging Unit>>

Figure 4:
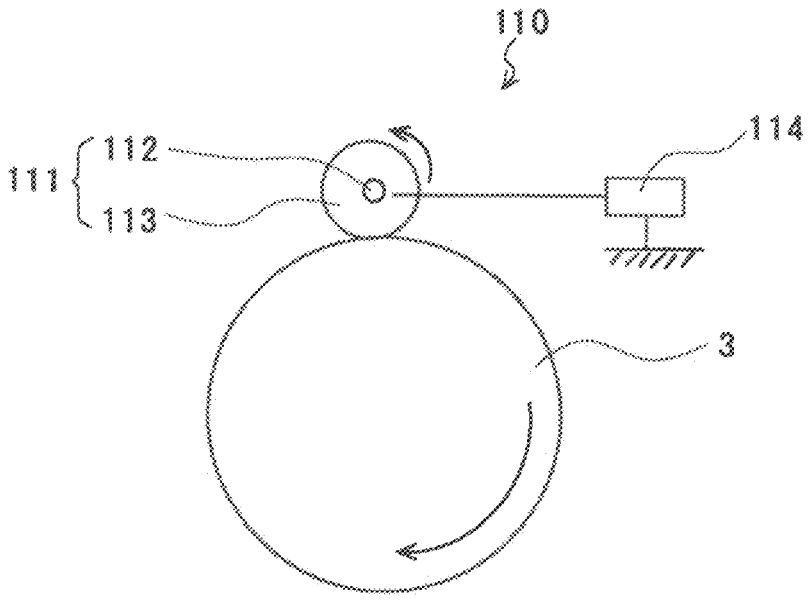
FIG. 4 is a diagram showing a structure of an embodiment of a charging unit serving as a charging unit used in the full-color image forming method and full-color image forming apparatus of the present invention.

The charging unit used in the full-color image forming method and full-color image forming apparatus of the present invention may be a contact charging device shown in FIGS. 3 and 4.

—Roller Charging Device—

FIG. 3 is a diagram showing a structure of an embodiment of a charging device used in the full-color image forming method and full-color image forming apparatus of the present invention. FIG. 3 is a schematic configuration of an example of a roller charging device 110 which is one type of the contact charging devices.

A photoconductor 3 serving as an image bearing member to be charged is rotated at a predetermined speed (process speed) in the direction indicated by the arrow. A charging roller 111 serving as a charging member, which is brought into contact with the photoconductor 3, contains a metal core 112 and a conductive rubber layer 113 formed on the outer surface of the metal core 112 in a shape of a concentric circle, as a basic structure. The both terminals of the metal core 112 are supported with bearings (not shown) so that the charging roller enables to rotate, and the charging roller 111 is pressed against the photoconductor 3 at a predetermined pressure by a pressurizing unit (not shown). The charging roller 111 in FIG. 3 therefore rotates along with the rotation of the photoconductor 3. The charging roller 111 is generally formed with a diameter of 16 mm in which a metal core 112 having a diameter of 9 mm is coated with a conductive rubber layer 113 having a moderate resistance of approximately 100,000 Ω·cm. The power supply 114 shown in the figure is electrically connected to the metal core 112 of the charging roller 111, and a predetermined bias is applied to the charging roller 111 by the power supply 114. Thus, the surface of the photoconductor 3 is uniformly charged at a predetermined polarity and potential.

—Fur Brush Charging Device—

In addition to the roller charging device, the charging device used in the present invention may be any form, such as a magnetic brush charging device, a fur brush charging device, or the like. It may be appropriately selected according to a specification or configuration of the image forming apparatus 1. When the magnetic brush charging device is used as the charging device, the magnetic brush includes a charging member formed of various ferrite particles such as Zn—Cu ferrite, etc., a non-magnetic conductive sleeve to support the ferrite particles, and a magnetic roller included in the non-magnetic conductive sleeve.

FIG. 4 is a diagram showing a structure of an embodiment of a charging device used in the full-color image forming method and full-color image forming apparatus of the present invention. Moreover, in the case of using the fur brush charging device, a material of the fur brush is, for example, a fur treated to be conductive with, for example, carbon, copper sulfide, a metal or a metal oxide, and the fur is coiled or mounted to a metal or another metal core which is treated to be conductive, thereby obtaining the charging device.

FIG. 4 shows a schematic configuration of one example of a contact fur brush charging device 120. A photoconductor 3 to be charged as an image bearing member is rotatably driven at a predetermined speed (process speed) in the direction indicated by the arrow. The fur brush roller 121 formed of a fur brush is brought into contact with the photoconductor 3, with a predetermined nip width and a predetermined pressure with respect to elasticity of a brush part 123.

The fur brush roller as the contact charging device in the present invention having an outer diameter of 14 mm and a longitudinal length of 250 mm is a roll brush. In this fur brush, a tape formed of a pile of conductive rayon fiber REC-B (manufactured by Unitika Ltd.), as a brush part, is spirally coiled around a metal core having a diameter of 6 mm, which serves also as an electrode. A brush of the brush part is of 300 denier/50 filament, and a density of 155 fibers per 1 square millimeter. This roll brush is once inserted into a pipe having an internal diameter of 12 mm with rotating in a certain direction, and is set so as to be a concentric circle relative to the pipe. Thereafter, the roll brush in the pipe is left in an atmosphere of high humidity and high temperature so as to twist the fibers of the fur.

The resistance of the fur brush roller is $1\times10^5\Omega$ at an applied voltage of 100 V. This resistance is calculated from the current obtained when the fur brush roller is contacted with a metal drum having a diameter of 30 mm with a nip width of 3 mm, and a voltage of 100 V is applied thereon. The resistance of the brush charging device should be $1\times10^4\Omega$ or more in order to prevent image defect caused by an insufficient charge at the charging nip part when the photoconductor to be charged happens to have defects caused by low pressure resistance, such as pin holes thereon and an excessive leak current therefore runs into the defects. Moreover, the resistance needs to be $1\times10^7\Omega$ or less in order to sufficiently charge the surface of the photoconductor.

The material of the fur brush is not particularly limited, and may be appropriately selected depending on the intended purpose. Examples of the material of the fur brush include, in addition to REC-B, REC-C, REC-M1, REC-M10, manufactured by Unitika Ltd., SA-7, manufactured by Toray Industries, Inc., THUNDERON, manufactured by Nihon Sanmo Dyeing Co., Ltd., BELTRON, manufactured by Kanebo Gohsen, Ltd., KURACARBO in which carbon is dispersed in rayon, manufactured by Kuraray Co., Ltd., and ROVAL, manufactured by Mitsubishi Rayon Co., Ltd. The brush is of preferably 3 denier to 10 denier per fiber, 10 filaments per bundle to 100 filaments per bundle, and 80 fibers/$mm^2$ to 600 fibers/$mm^2$. The length of the fur is preferably 1 mm to 10 mm.

The fur brush roller is rotatably driven in the opposite (counter) direction to the rotation direction of the photoconductor at a predetermined peripheral velocity (surface velocity), and comes into contact with a surface of the photoconductor with a velocity difference. The power supply applies a predetermined charging voltage to the fur brush roller so that the surface of the photoconductor is uniformly charged at a predetermined polarity and potential.

The contact charge of the photoconductor with the fur brush roller is performed in the following manner: charges are mainly directly injected and the surface of the rotating photoconductor is charged at the substantially equal voltage to the applying charging voltage to the fur brush roller.

—Magnetic Brush Charging Device—

A magnetic brush charging device has the same configuration as that of the fur brush charging device shown in FIG. 4. FIG. 4 is a schematic configuration of one example of a magnetic brush charging device.

A photoconductor 3 serving as an image bearing member to be charged is rotatably driven at a predetermined speed (process speed) in the direction indicated by the arrow. The brush roller 121 formed of a magnetic brush is brought into contact with the photoconductor 3, with a predetermined nip width and a predetermined pressure with respect to elasticity of a brush part 123.

The magnetic brush as the contact charging member is formed of magnetic particles. For the magnetic particles, Zn—Cu ferrite particles having an average particle diameter of 25 μm and Zn—Cu ferrite particles having an average particle diameter of 10 μm are mixed together in a ratio by mass of 1/0.05, so as to obtain ferrite particles having an average particle diameter of 25 μm, which have peaks at each average particle diameter, and then the ferrite particles are coated with a resin layer having a moderate resistance, to thereby form magnetic particles. The contact charging member is formed of the aforementioned coated magnetic particles, a non-magnetic conductive sleeve which supports the coated magnetic particles, and a magnet roller which is included in the non-magnetic conductive sleeve. The coated magnetic particles are disposed on the sleeve with a thickness of 1 mm so as to form a charging nip of about 5 mm-wide with the photoconductor. The width between the magnetic particle-bearing sleeve and the photoconductor is adjusted to approximately 500 μm. The magnetic roller is rotated so that the sleeve is rotated at twice in speed relative to the peripheral speed of the surface of the photoconductor in the opposite direction of the rotation of the photoconductor, to thereby slidingly rub the photoconductor. Therefore, the magnetic brush is uniformly brought into contact with the photoconductor.

<Developing Step and Developing Unit>

Figure 5:
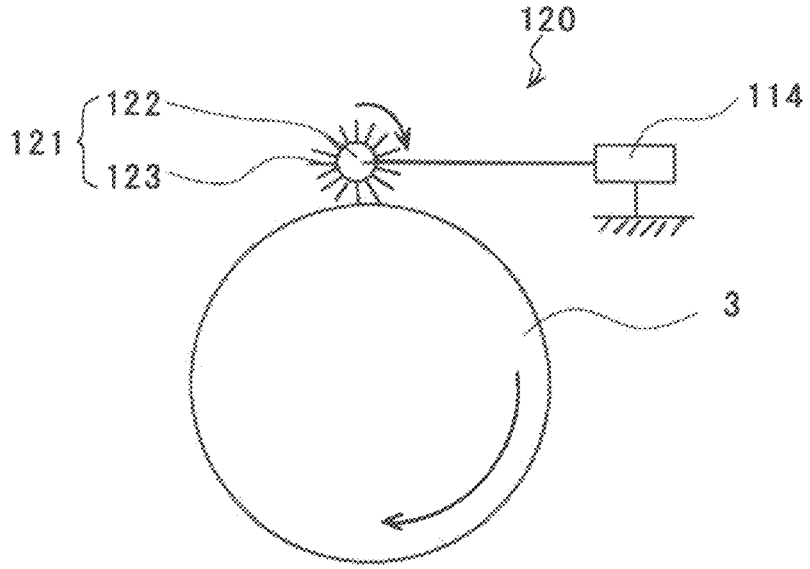
FIG. 5 is a diagram showing a structure of an embodiment of a developing device serving as a developing unit used in the full-color image forming method and full-color image forming apparatus of the present invention.

FIG. 5 is a diagram showing a structure of an embodiment of a developing device serving as a developing unit used in the full-color image forming method and full-color image forming apparatus of the present invention.

In the present invention, when a latent electrostatic image on the photoconductor is developed, an alternating electrical field is preferably applied. In a developing device 40 shown in FIG. 5, a power supply 46 applies a vibration bias voltage as developing bias, in which a direct-current voltage and an alternating voltage are superimposed, to a developing sleeve 41 during development. The potential of background part and the potential of image part are positioned between the maximum and the minimum of the vibration bias potential.

This forms an alternating electrical field, whose direction alternately changes, at a developing section 47. A toner 100 and a carrier in the developer are intensively vibrated in this alternating electrical field, so that the toner 100 overshoots the electrostatic force of constraint from the developing sleeve 41 and the carrier, and is attached to a latent electrostatic image on the photoconductor 3. The toner 100 is a toner produced by the above-described method for producing a toner of the present invention.

The difference between the maximum and the minimum of the vibration bias voltage (peak-to-peak voltage) is preferably from 0.5 kV to 5 kV, and the frequency is preferably from 1 kHz to 10 kHz. The waveform of the vibration bias voltage may be a rectangular wave, a sine wave or a triangular wave. The direct-current voltage of the vibration bias voltage is in a range between the potential at the background and the potential at the image as mentioned above, and is preferably set closer to the potential at the background from the viewpoint of inhibiting a toner deposition (fogging) on the background.

When the vibration bias voltage is a rectangular wave, it is preferred that a duty ratio be 50% or less. The duty ratio is a ratio of time when the toner leaps to the photoconductor 3 during a cycle of the vibration bias. In this way, the difference between the peak time value when the toner leaps to the photoconductor 3 and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier having an opposite polarity of current to the toner leaps to the photoconductor 3 and the time average value of bias can be decreased. Consequently the movement of the carrier can be restrained and the possibility of the carrier deposition on the background can be largely reduced.

<<Fixing Step and Fixing Unit>>

FIG. 6 is a diagram showing a structure of an embodiment of a fixing device serving as a fixing unit used in the full-color image forming method and the full-color image forming apparatus of the present invention.

The fixing device 70 shown in FIG. 6 preferably includes a heating roller 710 which is heated by electromagnetic induction by means of an induction heating unit 760, a fixing roller 720 (facing rotator) disposed in parallel to the heating roller 710, an endless fixing belt (heat resistant belt, toner heating medium) 730, which is formed of an endless strip stretched around the heating roller 710 and the fixing roller 720 and which is heated by the heating roller 710 and rotated by means of rotation of any of these rollers in the direction indicated by an arrow, and a pressure roller 740 (pressing rotator) which is pressed against the fixing roller 720 through the fixing belt 730 and which is rotated in forward direction with respect to the fixing belt 730.

The heating roller 710 is a hollow cylindrical magnetic metal member made of, for example, iron, cobalt, nickel or an alloy of these metals. The heating roller 710 is 20 mm to 40 mm in an outer diameter, and 0.3 mm to 1.0 mm in thickness, to be in construction of low heat capacity and a rapid rise of temperature.

The fixing roller 720 (facing rotator) is formed of a metal core 721 made of metal such as stainless steel, and an elastic member 722 made of a solid or foam-like silicone rubber having heat resistance to be coated on the metal core 721. Further, to form a contact section of a predetermined width between the pressure roller 740 and the fixing roller 720 by a compressive force provided by the pressure roller 740, the fixing roller 720 is constructed to have an outer diameter of about 20 mm to about 40 mm, and to be larger than the heating roller 710. The elastic member 722 is about 4 mm to about 6 mm in thickness. Owing to this construction, the heat capacity of the heating roller 710 is smaller than that of the fixing roller 720, so that the heating roller 710 is rapidly heated to make warm-up time period shorter.

The fixing belt 730 that is stretched around the heating roller 710 and the fixing roller 720 is heated at a contact section W1 with the heating roller 710 to be heated by the induction heating unit 760. Then, an inner surface of the fixing belt 730 is continuously heated by the rotation of the heating roller 710 and the fixing roller 720, and as a result, the whole belt will be heated.

Figure 7:
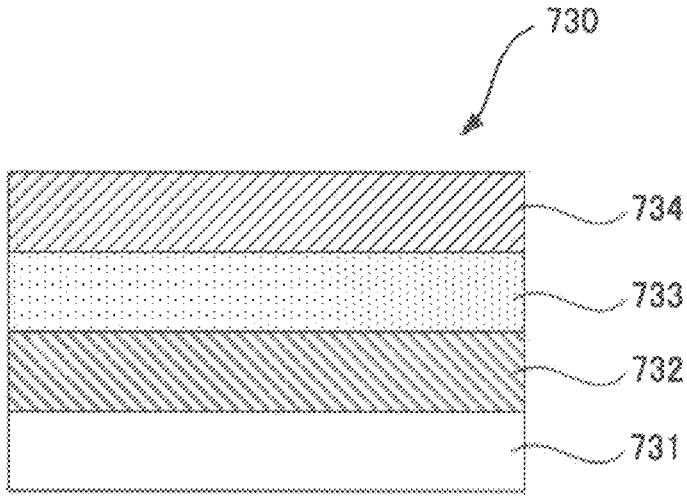
FIG. 7 is a diagram showing a structure of a fixing belt of the fixing device serving as a fixing unit used in the full-color image forming method and the full-color image forming apparatus of the present invention.

FIG. 7 is a diagram showing a structure of a fixing belt of a fixing device used in the full-color image forming apparatus and the full-color image forming method of the present invention. FIG. 7 shows a layer structure of the fixing belt 730. The fixing belt 730 consists of the following four layers in the order from an inner layer to a surface layer, a substrate 731, a heat generating layer 732, an intermediate layer 733, and a release layer 734.

The substrate 731 is formed of a resin layer, for example, a polyimide (PI) resin.

The heat generating layer 732 is a conductive material layer, for example, formed of Ni, Ag, SUS.

The intermediate layer 733 is an elastic layer for uniform fixation.

The release layer 734 is a resin layer, for example, formed of a fluorine-containing resin material for obtaining releasing effect and making oilless.

The release layer 734 preferably has a thickness of about 10 μm to about 300 μm, particularly preferably about 200 μm. In this manner, in the fixing device 70 as shown in FIG. 6, since the surface layer of the fixing belt 730 sufficiently covers a toner image formed on a recording medium 770, it becomes possible to uniformly heat and melt the toner image. The release layer 734; i.e., a surface release layer needs to have a thickness of 10 μm at minimum in order to secure abrasion resistance over time. In addition, when the release layer 734 exceeds 300 μm in thickness, the heat capacity of the fixing belt 730 increases, resulting in a longer warm-up time period. Further, additionally, a surface temperature of the fixing belt 730 is unlikely to decrease in the toner-fixing step, a cohesion effect of melted toner 100 at an outlet of the fixing portion cannot be obtained, and thus a releasing property of the fixing belt 730 is lowered, and the toner 100 of the toner image is attached onto the fixing belt 730 to thereby occur so-called hot offset. Moreover, as a substrate of the fixing belt 730, the heat generating layer 732 formed of a metal may be used, or the resin layer having heat resistance, such as a fluorine-containing resin, a polyimide resin, a polyamide resin, a polyamide-imide resin, a PEEK resin, a PES resin, and a PPS resin, may be used.

The pressure roller 740 is constituted with a cylindrical metal core 741 made of a metal having a high thermal conductivity, for example, copper or aluminum, and an elastic member 742 having a high heat resistance and toner releasing property that is located on the surface of the metal core 741. The metal core 741 may be made of SUS other than the above-described metals. The pressure roller 740 presses the fixing roller 720 through the fixing belt 730 to form a nip portion N. According to this embodiment, the pressure roller 740 is arranged to engage into the fixing roller 720 (and the fixing belt 730) by causing the hardness of the pressure roller 740 to be higher than that of the fixing roller 720, whereby the recording medium 770 is in conformity with the circumferential shape of the pressure roller 740, thus to provide the effect that the recording medium 770 is likely to come off from the surface of the fixing belt 730. This pressure roller 740 has an external diameter of about 20 mm to about 40 mm, which is the same as that of the fixing roller 720. However, the pressure roller 740 has a thickness of about 0.5 mm to about 2.0 mm, and is formed thinner than the fixing roller 720.

The induction heating unit 760 for heating the heating roller 710 by electromagnetic induction, as shown in FIG. 6, includes an exciting coil 761 serving as a field generation unit, and a coil guide plate 762 around which this exciting coil 761 is wound. The coil guide plate 762 has a semi-cylindrical shape that is located close to the perimeter surface of the heating roller 710. The exciting coil 761 is the one in which one long exciting coil wire is wound alternately in an axial direction of the heating roller 710 along this coil guide plate 762. Further, in the exciting coil 761, an oscillation circuit is connected to a driving power source (not shown) of variable frequencies. Outside of the exciting coil 761, an exciting coil core 763 of a semi-cylindrical shape that is made of a ferromagnetic material such as ferrites is fixed to an exciting coil core support 764 to be located in the proximity of the exciting coil 761.

<<Process Cartridge>>

A process cartridge used in the present invention includes: among an electrophotographic photoconductor; a charging device serving as a charging unit configured to charge the electrophotographic photoconductor; an exposing device serving as an exposing unit configured to expose the charged electrophotographic photoconductor to light so as to form a latent electrostatic image thereon; a developing device serving as a developing unit configured to develop the latent electrostatic image formed on the electrophotographic photoconductor using a toner so as to form a toner image; a transfer device serving as a transfer unit configured to transfer the toner image formed on the electrophotographic photoconductor, via an intermediate transfer medium or directly, to a recording medium; a fixing device serving as a fixing unit configured to fix the toner image on the recording medium by means of a heat and pressure fixation member; and a cleaning device serving as a cleaning unit configured to clean the residual toner adhering onto a surface of the electrophotographic photoconductor, from which the toner image has been transferred to the intermediate transfer medium or the recording medium using the transfer unit, at least the electrophotographic photoconductor and the developing unit are integrally supported, and the process cartridge is detachably attached to a main body of the image forming apparatus. The developing unit includes a toner produced by the above-described method for producing a toner of the present invention. The developing device and the charging device described above are suitable for use as the developing unit and the charging unit, respectively.

Figure 8:
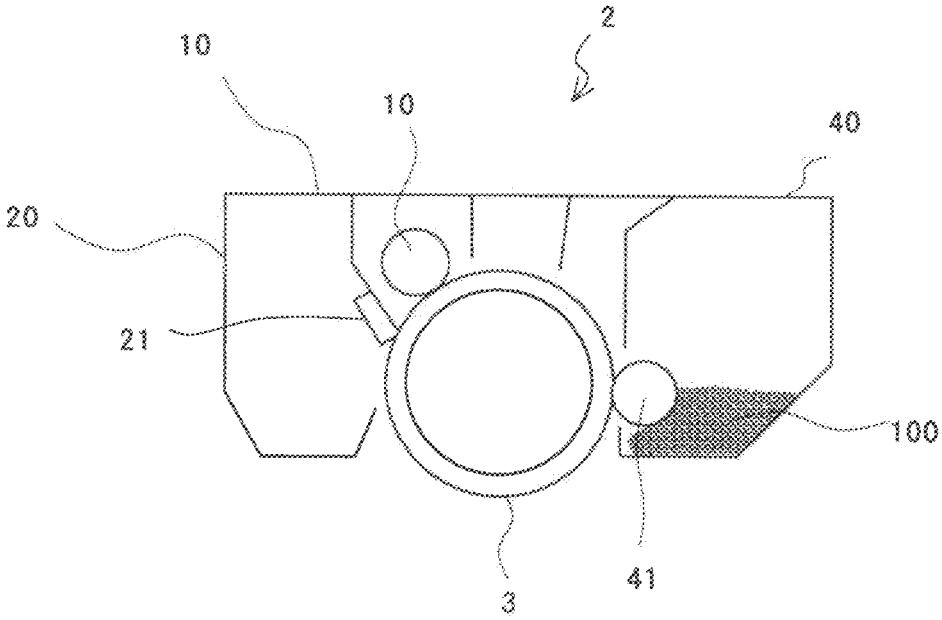
FIG. 8 is a diagram showing a structure of an embodiment of the process cartridge used in the full-color image forming method and full-color image forming apparatus of the present invention.

FIG. 8 is a diagram showing a structure of an example of the process cartridge used in the full-color image forming method and the full-color image forming apparatus of the present invention. A process cartridge 2 shown in FIG. 8 includes a photoconductor 3, a charging device 10, a developing device 40, and a cleaning device 20.

The operation of this process cartridge 2 will be described. The photoconductor 3 is rotated at a specific peripheral speed. In the course of rotating, the photoconductor 3 receives from the charging device 10 a uniform, positive or negative electrical charge of a specific potential around its periphery, and then receives image exposure light from an image exposing unit (not shown), such as slit exposure or laser beam scanning exposure, and in this way a latent electrostatic image is formed on the periphery of the photoconductor 3. The latent electrostatic image thus formed is then developed with a toner by a developing device 40 containing the toner, and the developed toner image is transferred by a transfer device (not shown) onto a recording medium that is fed from a paper feeder 60 (FIG. 10) to in between the photoconductor 3 and the transfer unit, in synchronization with the rotation of the photoconductor 3. The recording medium on which the image has been transferred is separated from the surface of the photoconductor 3, introduced into an image fixing unit (not shown) so as to fix the image thereon, and this product is printed out from the image forming apparatus 1 as a copy or a print. The surface of the photoconductor 3 after the image transfer is cleaned by the cleaning unit 20 so as to remove the residual toner 100 after the transfer, and is electrically neutralized and repeatedly used for image formation.

Figure 9:
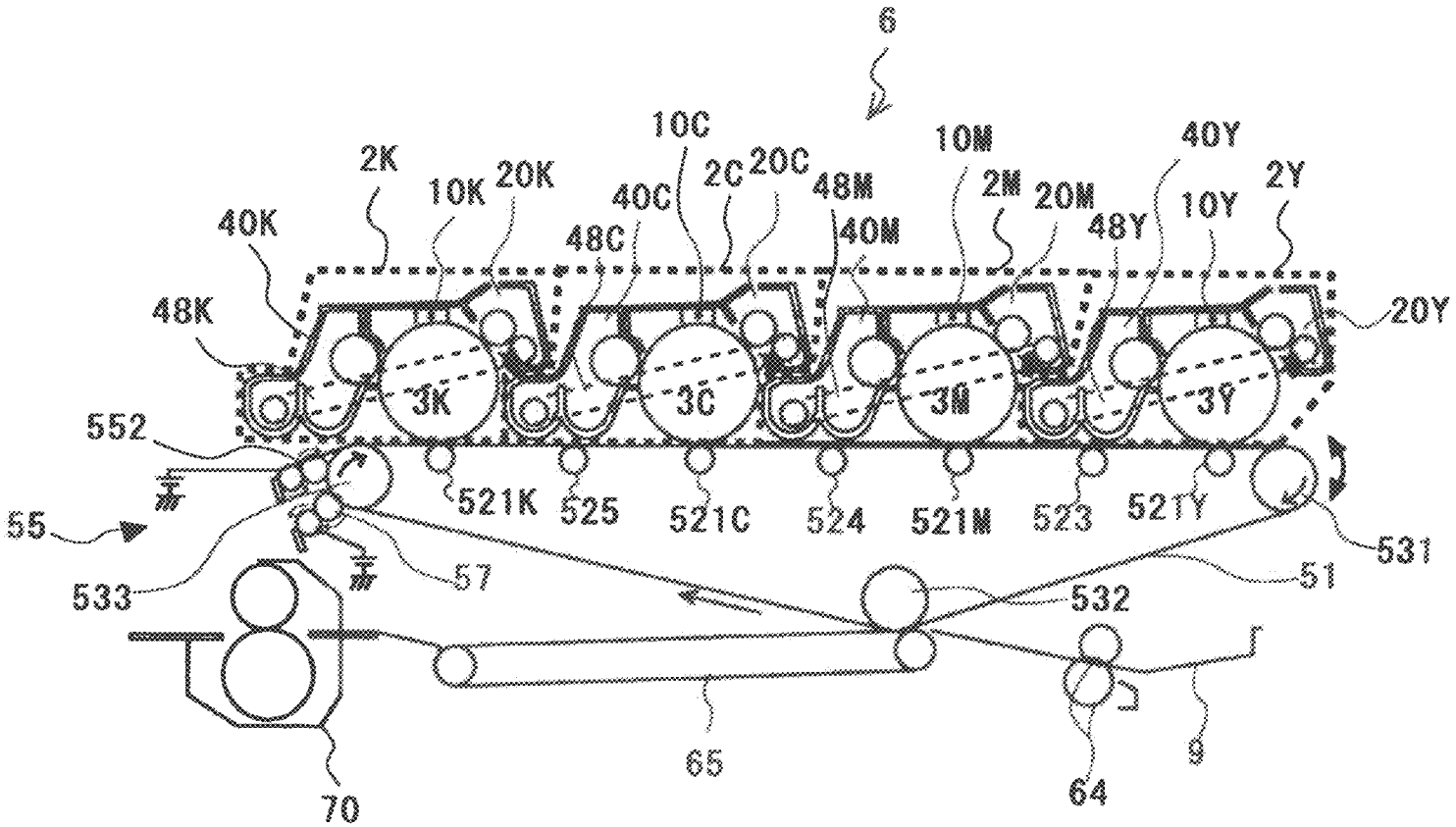
FIG. 9 is a diagram showing a structure of an embodiment of an image forming section as a main part used in the full-color image forming method and full-color image forming apparatus of the present invention.
Figure 10:
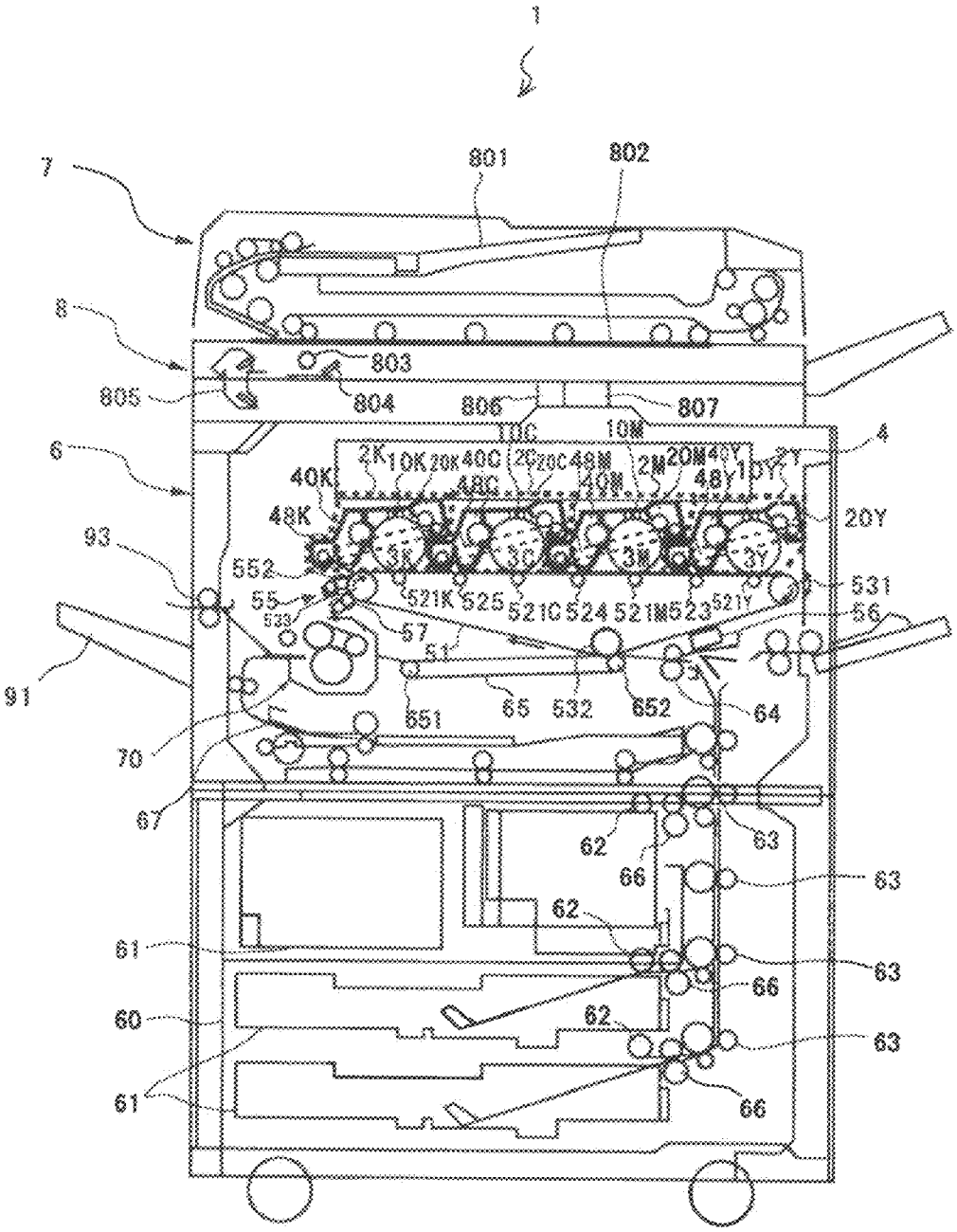
FIG. 10 is a diagram showing a structure of an embodiment of the full-color image forming method and full-color image forming apparatus of the present invention.

For example, a tandem image forming apparatus 1 shown in FIGS. 9 and 10 may be used as the full-color image forming apparatus of the present invention carried out by the full-color image forming method of the present invention.

FIG. 9 is a diagram showing a structure of an embodiment of an image forming section as a main part used in the full-color image forming method and the full-color image forming apparatus of the present invention.

FIG. 10 is a diagram showing a structure of an embodiment of the full-color image forming method and the full-color image forming apparatus of the present invention.

The transfer step and cleaning step in the full-color image forming method of the present invention and the transfer unit and cleaning unit in the full-color image forming apparatus of the present invention will be described with reference to FIGS. 9 and 10, hereinbelow.

In FIG. 10, the image forming apparatus 1 mainly includes exposing device 4 for writing an image for performing color image formation by electrophotography, image forming section 6, and a paper feeder 60 including feeder cassettes 61.

According to image signals, image processing is performed in an image processing unit (not shown) to convert to respective color signals of black (K), cyan (C), magenta (M), and yellow (Y) for image formation, and the color signals are sent to the exposing device 4 for wiring images. The exposing device 4 is a laser scanning optical system that includes, for example, a laser beam source, a deflector such as a rotary polygon mirror, a scanning imaging optical system, and a group of mirrors (all not shown), has four writing optical paths corresponding to the color signals, and performs image writing according to the color signals in the image forming section 6.

The image forming section 6 include photoconductors 3K, 3C, 3M and 3Y respectively for black, cyan, magenta, and yellow. An organic photoconductor (OPC) is generally used in the photoconductors 3K, 3C, 3M and 3Y for the respective colors. For example, charging devices 10K, 10C, 10M, 10Y, exposure section with laser light from the exposing device 4, developing devices 40K, 40C, 40M, 40Y for respective colors, primary transfer devices 521K, 521C, 521M, 521Y, cleaning devices 20K, 20C, 20M, 20Y, and charge-eliminating devices (not shown) are provided around the respective photoconductors 3K, 3C, 3M and 3Y. The developing devices 40K, 40C, 40M, 40Y employ a two-component magnetic brush development system. Further, an intermediate transfer belt 51 is interposed between the photoconductors 3K, 3C, 3M, 3Y and the primary transfer devices 521K, 521C, 521M, 521Y. Color toner images are successively transferred from respective photoconductors 3K, 3C, 3M, 3Y onto the intermediate transfer belt 51 to form superimposed toner images thereon.

In some cases, a pre-transfer charger 56 is preferably provided as a pre-transfer charging unit at a position that is outside the intermediate transfer belt 51 and after the passage of the final color through a primary transfer position and before a secondary transfer position. Before the toner images on the intermediate transfer belt 51, which have been transferred onto the photoconductors 3K, 3C, 3M, 3Y by a primary transfer unit, are transferred onto a recording medium 9 as a recording member, the pre-transfer charger 56 charges toner images evenly to the same polarity.

The toner images on the intermediate transfer belt transferred from the photoconductors 3K, 3C, 3M, 3Y include a halftone portion and a solid image portion or a portion in which the level of superimposition of toners is different. Accordingly, in some cases, the charge amount varies from a toner image to a toner image. Further, due to separation discharge generated in spaces on an adjacent downstream side of the primary transfer unit in the direction of movement of the intermediate transfer belt, a variation in charge amount may occur within toner images on the intermediate transfer belt after the primary transfer. The variation in charge amount within the same toner image disadvantageously decreases a transfer latitude in the secondary transfer unit that transfers the toner images from the intermediate transfer belt onto the recording medium. Accordingly, the toner images before transferred onto the recording medium are evenly charged to the same polarity by the pre-transfer charger to eliminate the variation in charge amount within the same toner image and to improve the transfer latitude in the secondary transfer unit.

Thus, according to the image forming method wherein the toner images transferred from the photoconductors 3K, 3C, 3M, 3Y onto the intermediate transfer belt are evenly charged by the pre-transfer charger, even when there are variations in charge amount of the toner images on the intermediate transfer belt, the transfer properties in the secondary transfer unit can be rendered almost constant over each portion of the toner images located on the intermediate transfer belt. Accordingly, the decrease in the transfer latitude upon transfer of the toner images onto the recording medium can be suppressed, and the toner images can be stably transferred.

In the image forming method, the amount of charge applied by the pre-transfer charger varies depending upon the moving speed of the intermediate transfer belt to be charged. For example, when the moving speed of the intermediate transfer belt is slow, the period of time, for which the same part in the toner images on the intermediate transfer belt passes through a section of charging by the pre-transfer charger, becomes longer. Therefore, in this case, the charge amount is increased. On the other hand, when the moving speed of the intermediate transfer belt is high, the charge amount of the toner images on the intermediate transfer belt is decreased. Accordingly, when the moving speed of the intermediate transfer belt changes during the passage of the toner images on the intermediate transfer belt through the position of charging by the pre-transfer charger, preferably, the pre-transfer charger is regulated according to the moving speed of the intermediate transfer belt so that the charge amount of the toner images does not change during the passage of the toner images on the intermediate transfer belt through the position of charging by the pre-transfer charger.

Conductive rollers 523, 524, 525 are provided between the primary transfer devices 521K, 521C, 521M, 521Y. The recording medium 9 is fed from a paper feeder 60 and then is supported on a transfer belt 51 through a pair of registration rollers 64. At a portion where the intermediate transfer belt 51 comes into contact with a secondary transfer device (not shown), the toner images on the intermediate transfer belt 51 are transferred by a secondary transfer roller (not shown) onto the recording medium 9 to perform color image formation.

The recording medium 9 after image formation is transferred by a transfer belt 65 after secondary transfer to a fixing device 70 where the color image is fixed to provide a fixed color image. The residual toner remaining on the intermediate transfer belt 51 after transfer is removed form the belt by an intermediate transfer belt cleaning device 55.

The polarity of the toner on the intermediate transfer belt 51 before transfer onto the recording medium 9 has the same negative polarity as the polarity upon development. Accordingly, a positive transfer bias voltage is applied to the secondary transfer roller, and the toner is transferred onto the recording medium 9. The nip pressure in this portion affects the transferability and significantly affects the fixing ability. The toner remaining after transfer and located on the intermediate transfer belt 51 is subjected to discharge electrification to positive polarity side; i.e., 0 to positive polarity, in a moment of the separation of the recording medium 9 from the intermediate transfer belt 51. Toner images formed on the jammed recording medium 9 or toner images in a non-image section of the recording medium 9 are not influenced by the secondary transfer and thus, maintain negative polarity.

The thickness of the photoconductor layer, the beam spot diameter of the optical system, and the quantity of light are 30 μm, 50 μm×60 μm, and 0.47 mW, respectively. The developing step is performed under such conditions that the charge (exposure side) potential V0 of the photoconductor (black) 3K is −700 V, potential VL after exposure is −120 V, and the development bias voltage is −470 V, that is, the development potential is 350 V. The visible image of the toner 100 (black) formed on the photoconductor (black) 3K is then subjected to transfer (intermediate transfer belt and recording medium 9) and the fixing step and consequently is completed as an image. Regarding the transfer, all the colors are first transferred from the primary transfer devices 521K, 521C, 521M, 521Y to the intermediate transfer belt 51, followed by transferring to the recording medium 9 by applying bias to a separate secondary transfer roller (not shown).

Next, a cleaning device for the photoconductor will be described in detail. In FIG. 9, the developing devices 40K, 40C, 40M, 40Y are connected to respective cleaning devices 20K, 20C, 20M, 20Y through toner transfer tubes 48K, 48C, 48M, 48Y (dashed lines in FIG. 8). A screw (not shown) is provided within the toner transfer tubes 48K, 48C, 48M, 48Y, and the toners 100 recovered in the cleaning devices 20K, 20C, 20M, 20Y are transferred to the respective developing devices 40K, 40C, 40M, 40Y.

A conventional direct transfer system including a combination of four photoconductors with belt transfer has the following drawback. Specifically, upon abutting of the photoconductor against the recording medium, paper dust adheres onto the photoconductor. Therefore, the toner recovered from the photoconductor contains paper dust and thus cannot be used, because in the image formation, image deterioration such as toner dropouts occurs. Further, in a system including a combination of one photoconductor with an intermediate transfer belt, the adoption of the intermediate transfer belt has eliminated a problem of the adherence of paper dust onto the photoconductor upon transfer of an image onto the recording medium. In this system, however, when recycling of the residual toner on the photoconductor is contemplated, the separation of the mixed color toners is practically impossible. The use of the mixed color toners as a black toner has been proposed. However, even when all the colors are mixed, a black color is not produced. Further, colors vary depending upon printing modes. Accordingly, in the structure of a single photoconductor, recycling of the toner is impossible.

By contrast, in the full-color image forming apparatus, since the intermediate transfer belt is used, the contamination with paper dust less occurs. Further, the adherence of paper dust onto the intermediate transfer belt during the transfer onto the paper can also be prevented. Since each of the photoconductors 3K, 3C, 3M, 3Y uses independent respective color toners, there is no need to perform contacting and separating of the photoconductor cleaning devices 20K, 20C, 20M, 20Y. Accordingly, only the toner can be reliably recovered.

The positively charged toner remaining after transfer on the intermediate transfer belt 51 is removed by cleaning with a conductive fur brush 552 to which a negative voltage has been applied. The toner remaining after transfer can be almost completely removed by cleaning with the conductive fur brush 552. The toner, paper dust, talc and the like, which are not cleaned and unremoved with the conductive fur brush 552 are negatively charged by a negative voltage of the conductive fur brush 552. The subsequent primary transfer of black is transfer by a positive voltage. Accordingly, the negatively charged toner and the like are attracted toward the intermediate transfer belt 51, and thus, the transfer to the photoconductor (black) 3K side can be prevented.

Next, the intermediate transfer belt 51 used in the image forming apparatus will be described. The intermediate transfer belt 51 is preferably formed of a single resin layer, and if necessary, may include an elastic layer and a surface layer.

The resin material for forming the resin layer is not particularly limited and may be appropriately selected depending on the intended purpose. Examples thereof include polycarbonate resins, fluorine resins such as ETFE and PVDF; polystyrenes, chloropolystyrenes, poly-α-methylstyrenes; styrene resins (homopolymers or copolymers containing styrene or styrene substituents) such as styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers and styrene-phenyl methacrylate copolymers); styrene-α-chloromethyl acrylate copolymers, styrene-acrylonitrile acrylate copolymers, methyl methacrylate resins, and butyl methacrylate resins; ethyl acrylate resins, butyl acrylate resins, modified acrylic resins (such as silicone-modified acrylic resins, vinyl chloride resin-modified acrylic resins and acrylic urethane resins); vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins. These resins may be used alone or in combination.

Examples of elastic materials (elastic rubbers, elastomers) forming the elastic layer include, but not limited to, butyl rubber, fluorine-based rubber, acryl rubber, EPDM rubber, NBR rubber, acrylonitrile-butadiene-styrene natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, hydrogenated nitrile rubber, and thermoplastic elastomers, for example, polystyrene, polyolefin, polyvinyl chloride, polyurethane, polyamide, polyurea, polyester and fluorine resins. These rubbers may be used alone or in combination.

The material used for the surface layer is not particularly limited but is required to reduce toner adhesion force to the surface of the intermediate transfer belt so as to improve the secondary transfer property. The surface layer preferably contains one or two or more of a polyurethane resin, a polyester resin, and an epoxy resin, and one or two or more of materials that reduce surface energy and enhance lubrication, for example, powders or particles such as fluorine resin, fluorine compound, carbon fluoride, titanium dioxide, and silicon carbide, or a dispersion of the materials having different particle diameters. In addition, it is possible to use a material such as fluorine rubber that is treated with heat so that a fluorine-rich layer is formed on the surface and the surface energy is reduced.

The resin layer and elastic layer preferably contain a conductive agent for adjusting resistance. The conductive agent for adjusting resistance is not particularly limited and may be appropriately selected depending on the intended purpose. Examples thereof include, but not limited to, carbon black, graphite, metal powders such as aluminum and nickel; conductive metal oxides such as tin oxide, titanium oxide, antimony oxide, indium oxide, potassium titanate, antimony tin oxide (ATO), and indium tin oxide (ITO). The conductive metal oxides may be coated with insulating fine particles such as barium sulfate, magnesium silicate, and calcium carbonate.

In FIG. 10, the image forming apparatus 1 includes a paper feeder 60 on which a recording medium 9 is placed, a scanner 8, which is arranged over the main body of the image forming apparatus, and an automatic document feeder (ADF) 7 which is arranged over the scanner 8.

In the center of the image forming apparatus 1 an intermediate transfer medium 51 in the form of an endless belt is provided. As shown in FIG. 10, the intermediate transfer medium 51 is stretched around three support rollers 531, 532, 533 and rotates clockwise. An intermediate transfer medium cleaning device 55 for removing residual toner on the intermediate transfer medium 51 after image transfer is provided near the support roller 533 of the three support rollers. A tandem image forming apparatus 1 includes process cartridges 2K, 2C, 2M, 2Y as four image forming units for yellow, cyan, magenta, and black, which face the intermediate transfer medium 51 stretched around the support roller 531 and the support roller 532 of the three support rollers, and are arranged side by side in the transfer rotation direction thereof.

An exposing device 4 is provided over the tandem image forming apparatus 1 as shown in FIG. 10. On the other hand, a secondary transfer device (not shown) is provided in the side opposite to the side where the tandem image forming apparatus 1 is provided, via the intermediate transfer medium 51. The secondary transfer device 54 has an endless transfer belt 65 stretched around a pair of rollers 651 and 652 and is arranged so as to press against the support roller 652 via the intermediate transfer medium 51, thereby transferring an image on the intermediate transfer medium 51 onto the recording medium 9. A fixing device 70 configured to fix the transferred image on the recording medium 9 is provided near the secondary transfer device 54.

The fixing device 70 has an endless fixing belt 730 and a pressure roller 740 pressed against the fixing belt 730. The secondary transfer device 54 includes a conveyance function for the recording medium 9, in which the recording medium 9 on which the image has been transferred is conveyed to the fixing device 70. As the secondary transfer device 54, a transfer roller or a non-contact charger may be provided, however, these are difficult to provide in conjunction with the conveyance function for the recording medium 9. A sheet inversion device 67 for turning over the recording medium 9 to form images on both sides of the recording medium 9 is provided parallel to the tandem image forming apparatus 1 and under the secondary transfer device 54 and fixing device 70.

The operation of image formation of the image forming apparatus 1 will be described.

At first, a document is placed on a document table 801 of the automatic document feeder 7, when a copy is made using the full-color image forming apparatus 1. Alternatively, the automatic document feeder 7 is opened, the document is placed onto a contact glass 802 of the scanner 8, and the automatic document feeder 7 is closed.

When a start switch (not shown) is pressed, a document placed on the automatic document feeder 7 is conveyed onto the contact glass 802. When the document is initially placed on the contact glass 802, the scanner 8 is immediately driven to operate a first carriage 804 and a second carriage 805. At the first carriage 804, light is applied from a light source to the document, and reflected light from the document is further reflected toward the second carriage 805. The reflected light is further reflected by a mirror of the second carriage 805 and passes through image-forming lens 806 into CCD 807 as a read sensor to thereby read the document.

When the start switch (not shown) is pressed, one of the support rollers 531, 532 and 533 is rotated by a drive motor (not shown), and as a result, the other two support rollers are rotated by the rotation of the driven support roller. In this way, the intermediate transfer medium 51 runs around the support rollers 531, 532 and 533. Simultaneously, the individual image forming units 2K, 2C, 2M, 2Y in the image forming section 6 respectively rotate their photoconductors 3K, 3C, 3M and 3Y to thereby form black, yellow, magenta, and cyan monochrome images on the photoconductors 3K, 3C, 3M and 3Y, respectively. With the conveyance of the intermediate transfer medium 51, the monochrome images are sequentially transferred to form a composite color image on the intermediate transfer medium 51.

Separately, when the start switch (not shown) is pressed, one of feeder rollers 62 of the feeder cassettes 61 is selectively rotated, the recording media 9 are ejected from one of multiple feeder cassettes 61 provided in the paper feeder 60 and are separated in a separation roller 66 one by one into a feeder path, are conveyed by a conveyance roller 63 into a feeder path in the image forming apparatus 1 and are bumped against registration rollers 64.

Alternatively, pressing the start switch rotates a paper feeding roller 62 to eject the recording media 9 on a manual bypass tray, and the recording media are separated one by one on a separation roller 66 into a manual bypass feeder path and are bumped against the registration rollers 64.

The registration rollers 64 are rotated synchronously with the movement of the composite color image on the intermediate transfer medium 51 to convey the recording medium 9 into between the intermediate transfer medium 51 and the secondary transfer device (not shown), and the composite color image is transferred onto the recording medium 9 by action of the secondary transfer device 54 to thereby form a color image.

The recording medium 9 on which the image has been transferred is conveyed by the secondary transfer device 54 into the fixing device 70, and heat and pressure are applied to the recording medium 9 in the fixing device 70 to fix the transferred image, changes its direction by action of a switch claw, and is ejected by an ejecting roller 93 to be stacked on an output tray 91. Alternatively, the moving direction of the recording medium 9 is changed by the switching claw, and the recording medium 9 is conveyed to the sheet inversion device 67 where it is inverted, and guided again to the transfer position in order that an image is formed also on the back surface thereof, then the recording medium 9 is ejected by the ejecting roller 93 and stacked on the output tray 91.

On the other hand, in the intermediate transfer medium 51 after the image transfer, the toner remaining on the intermediate transfer medium 51 after the image transfer, is removed by the intermediate transfer medium cleaning device 55, and the intermediate transfer medium 51 again gets ready for image formation by the tandem image forming apparatus 1. The registration roller 64 is generally used in a grounded state. Bias may also be applied to the registration roller 64 to remove paper dust of the recording medium 9.

EXAMPLES

The present invention will be described in more detail with reference to the following Examples and Comparative Examples. However, it should be noted that the present invention is not limited to these Examples and Comparative Examples.

<Production of Toner>

An example of production of a toner used for evaluation will be specifically described. A toner used in the present invention will not be limited thereto.

—Preparation of Non-Crystalline Polyester Resin Fine Particles—

Organic Fine Particle Dispersion Liquids 1 to 3 were prepared according to the compositions and the production conditions as shown in Table 1.

Into a 5 liter flask equipped with a stirrer, a nitrogen introducing tube, a temperature sensor and a rectifying column, 386 parts by mass of bisphenol A ethylene oxide adduct (average number of moles added: 2.2), 428 parts by mass of trimethylolpropane, A parts by mass of terephthalic acid, and B parts by mass of trimellitic acid were charged, and heated to 190° C. for 1 hour. After it was confirmed that the reaction system was uniformly stirred was confirmed, 1.2 parts by mass of dibutyltin oxide was charged into the flask. While generated water was distilled away, the system temperature was increased from 190° C. to 240° C. for 6 hours, and dehydration condensation reaction was performed at 240° C. for 3 hours, to thereby obtain a partly crosslinked polyester resin. In the final step, C parts by mass of trimellitic acid was added to the flask, and dehydration condensation reaction was performed at 240° C. for 1 hour, to thereby prepare an acid value.

Next, the polyester resin in the melted state was transferred to a Manton Gaulin High Pressure Homogenizer manufactured by APV Gaulin Inc. at a rate of D g/min. In a separately prepared aqueous medium tank, a diluted ammonia water having a concentration of 0.37% by mass which was obtained by diluting ammonia water reagent with ion-exchanged water was charged. While the diluted ammonia water was heated at 120° C. with a heat exchanger, the diluted ammonia water was transferred at a rate of 0.1 L/min, together with the polyester resin in the melted state to the Manton Gaulin High Pressure Homogenizer manufactured by APV Gaulin Inc. The mixture was emulsified at a pressure of 150 kg/cm$^2$, to thereby obtain organic resin particles of non-crystalline polyester resins.

TABLE 1

| Organic fine particle dispersion liquid | Type of fine particles | Amount of terephthalic acid A parts by mass | Amount of trimellitic acid B parts by mass | Amount of trimellitic acid C parts by mass | Feeding ratio of polyester resin D g/min |
|---|---|---|---|---|---|
| 1 | 1A | 1,390 | 10 | 14 | 50 |
| 2 | 2A | 1,390 | 10 | 14 | 75 |
| 3 | 3A | 1,390 | 10 | 14 | 100 |

The obtained properties of the organic fine particles are shown in Table 2.

TABLE 2

| Type of fine particles | Average particle diameter (nm) | Amount of crosslinked component (%) | Acid value | Glass transition temperature Tg (° C.) |
|---|---|---|---|---|
| 1A | 30 | 5 | 25 | 65 |
| 2A | 50 | 6 | 28 | 67 |
| 3A | 110 | 5 | 27 | 68 |

The average particle diameter was measured using LA-920, manufactured by HORIBA, Ltd.

The amount of the crosslinked component, acid value and glass transition temperature Tg were obtained by analyzing the organic fine particle dispersion liquid, which had been dried, by the following method.

—Amount of Crosslinked Component—

The amount of the crosslinked component of the organic fine particles was obtained in such a manner that 10 parts by mass of the organic fine particles were stirred and dissolved in 100 parts by mass of ethyl acetate, and then the mixture was filtered using a 0.2 μm-membrane filter, followed by drying, and weighing the dried product.

—Acid Value—

In the present invention the acid value was measured in the following manner:

Measurement instrument: automatic potentiometric titrator DL-53 Titrator (Metller-Toledo International Inc.)
Electrode: DG113-SC (Metller-Toledo International Inc.)
Analysis software: LabX Light Version 1.00.000
Calibration: mixture solvent of 120 mL toluene and 30 mL ethanol was used.
Measurement temperature: 23° C.
The measurement conditions were as follows.

Stir
Speed [%] 25
Time [s] 15
EQP titration
Titrant/Sensor
Titrant $CH_3ONa$
Concentration[mol/L] 0.1
Sensor DG115
Unit of measurement mV
Predispensing to volume
Volume [mL] 1.0
Wait time [s] 0
Titrant addition Dynamic
dE (set) [mV] 8.0
dV (min) [mL] 0.03
dV (max) [mL] 0.5
Measure mode Equilibrium controlled
dE [mV] 0.5
dt [s] 1.0
t (min) [s] 2.0
t (max) [s] 20.0
Recognition
Threshold 100.0
Steepest jump only No
Range No
Tendency None
Termination
at maximum volume [mL] 10.0
at potential No
at slope No
after number EQPs Yes
n=1
comb. termination conditions No
Evaluation
Procedure Standard
Potential 1 No
Potential 2 No
Stop for reevaluation No —Glass Transition Temperature Tg—

The glass transition temperature Tg of the organic fine particles was measured using DSC system (a differential scanning calorimeter) (DSC-60, manufactured by manufactured by SHIMADZU CORPORATION) in the following manner.

First, about 10 mg of a sample was placed in an aluminum-sample container, the container was mounted on a holder unit and then set in an electric oven. The sample was heated from room temperature to 150° C. at a temperature increase rate of 10° C./min, left standing at 150° C. for 10 minutes, and then cooled to room temperature and left standing for 10 minutes. The sample was heated again under a nitrogen atmosphere to 150° C. at a temperature increase rate of 10° C./min to thereby measure a DSC curve using a differential scanning calorimeter DSC. Using the analysis system in the DSC system DSC-60, the glass transition temperature Tg was calculated from a tangent point between an endothermic curve obtained near Tg and the base line.

—Preparation of Crystalline Polyester Resin Fine Particles—

Organic Fine Particle Dispersion Liquids 4 to 12 were prepared according to the compositions and production conditions shown in Table 3.

In a 5 liter flask equipped with a stirrer, and a nitrogen-introducing tube, a temperature sensor, and a rectifying column, 256 parts by mass of 1,6-hexanediol, 225 parts by mass of 1,4-butanediol, A parts by mass of fumaric acid, and B parts by mass of sebacic acid were charged, and heated to 190° C. for 1 hour. After it was confirmed that the reaction system was uniformly stirred, 1.2 parts by mass of dibutyltin oxide was charged into the flask.

While generated water was distilled away, the system temperature was increased from 190° C. to 240° C. for 6 hours, and dehydration condensation reaction was performed at 240° C. for 3 hours, to thereby obtain a crystalline polyester resin. In the final step, C parts by mass of trimellitic acid was added to the flask, and dehydration condensation reaction was performed for at 240° C. for 1 hour, to thereby prepare an acid value.

Next, the polyester resin in the melted state was transferred to a Manton Gaulin High Pressure Homogenizer manufactured by APV Gaulin Inc. at a rate of D g/min.

In a separately prepared aqueous medium tank, a diluted ammonia water having a concentration of 0.37% by mass which was obtained by diluting ammonia water reagent with ion-exchanged water was charged. While the diluted ammonia water was heated at 120° C. with a heat exchanger, the diluted ammonia was transferred at a rate of 0.1 L/min, together with the polyester resin in the melted state to the Manton Gaulin High Pressure Homogenizer manufactured by APV Gaulin Inc.

The mixture was emulsified at a pressure of 150 kg/cm$^2$, to thereby obtain organic resin particles of crystalline polyester resins.

TABLE 3

| Organic fine particle dispersion liquid | Type of fine particles | Amount of fumaric acid A parts by mass | Amount of sebacic acid B parts by mass | Amount of trimellitic acid C parts by mass | Feeding ratio of polyester resin D g/min |
|---|---|---|---|---|---|
| 4 | 1C | 320 | 210 | 10 | 50 |
| 5 | 2C | 320 | 210 | 10 | 75 |
| 6 | 3C | 320 | 210 | 10 | 100 |
| 7 | 4C | 265 | 275 | 10 | 150 |
| 8 | 5C | 200 | 345 | 10 | 200 |
| 9 | 6C | 320 | 210 | 0 | 75 |
| 10 | 7C | 320 | 10 | 20 | 75 |
| 11 | 8C | 320 | 10 | 30 | 75 |
| 12 | 9C | 320 | 10 | 40 | 75 |

TABLE 3-continued

| Organic fine particle dispersion liquid | Type of fine particles | Amount of fumaric acid A parts by mass | Amount of sebacic acid B parts by mass | Amount of trimellitic acid C parts by mass | Feeding ratio of polyester resin D g/min |
|---|---|---|---|---|---|

The properties of the obtained organic fine particles are shown in Table 4.

TABLE 4

| Type of fine particles | Average particle diameter (nm) | Melting point T½ (° C.) | Acid value |
|---|---|---|---|
| 1C | 30 | 72 | 25 |
| 2C | 50 | 73 | 28 |
| 3C | 110 | 74 | 27 |
| 4C | 50 | 52 | 26 |
| 5C | 53 | 43 | 21 |
| 6C | 55 | 68 | 0 |
| 7C | 50 | 77 | 55 |
| 8C | 49 | 79 | 78 |
| 9C | 52 | 83 | 96 |

The average particle diameter was measured using LA-920, manufactured by HORIBA, Ltd.

The acid value was obtained by analyzing the organic fine particle dispersion liquid which had been dried by an automatic potentiometric titrator DL-53 Titrator (Metller-Toledo International Inc.).

The melting point was obtained by measuring the dried organic fine particles using a flow tester CFT500, manufactured by SHIMADZU CORPORATION.

—Preparation of Solution or Dispersion of Toner Material—

—Synthesis of Unmodified Polyester Resin (Low Molecular Weight Polyester Resin)—

Into a reaction vessel equipped with a condenser, a stirrer, and a nitrogen-introducing tube, 67 parts by mass of bisphenol A ethylene oxide (2 mol) adduct, 84 parts by mass of bisphenol A propionoxide (3 mol) adduct, 274 parts by mass of terephthalic acid, and 2 parts by mass of dibutyltin oxide were charged, allowing the resultant mixture to react for 8 hours at 230° C. under normal pressure, so as to obtain a reaction liquid. Subsequently, the reaction liquid was allowed to react for 5 hours under reduced pressure of 10 mmHg to 15 mmHg, to thereby synthesize an unmodified polyester resin.

The thus-obtained unmodified polyester resin had an acid value of 10 mgKOH/g, a number average molecular weight Mn of 2,100, a weight average molecular weight Mw of 5,600, and a glass transition temperature Tg of 55° C.

—Synthesis of Prepolymer—

Into a reaction vessel equipped with a condenser, a stirrer, and a nitrogen-introducing tube, 682 parts by mass of bisphenol A ethylene oxide (2 mol) adduct, 81 parts by mass of bisphenol A propylene oxide (2 mol) adduct, 283 parts by mass of terephthalic acid, 22 parts by mass of trimellitic anhydride, and 2 parts by mass of dibutyltin oxide were charged, allowing the resultant mixture to react for 8 hours at 230° C. under normal pressure. Subsequently, the reaction mixture was allowed to react for 5 hours under reduced pressure of 10 mmHg to 15 mmHg, to thereby synthesize intermediate polyester. The thus-obtained intermediate polyester had a number average molecular weight Mn of 2,100, a weight average molecular weight Mw of 9,600, a glass transition temperature Tg of 55° C., an acid value of 0.5 mgKOH/g, and a hydroxyl group value of 49 mgKOH/g.

Subsequently, into a reaction vessel equipped with a condenser, a stirrer, and a nitrogen-introducing tube, 411 parts by mass of the intermediate polyester, 89 parts by mass of isophorone diisocyanate, and 500 parts by mass of ethyl acetate were charged, allowing the resultant mixture to react for 5 hours at 100° C. to thereby synthesize a prepolymer, i.e., a polymer reactive with an active hydrogen group-containing compound. The thus obtained prepolymer had a free isocyanate content of 1.60% by mass and solid content concentration of 50% by mass (150° C., after being left for 45 minutes).

—Synthesis of Ketimine (Active Hydrogen Group-Containing Compound)—

In a reaction vessel equipped with a stirring rod and a thermometer, 30 parts by mass of isophorone diamine and 70 parts by mass of methyl ethyl ketone were charged, allowing the mixture to react at 50° C. for 5 hours to synthesize a ketimine compound as an active hydrogen group-containing compound. The obtained ketimine compound had an amine value of 423 mgKOH/g.

—Preparation of Masterbatch (MB)—

Water (1,000 parts by mass), 540 parts by mass of carbon black ("Printex 35" manufactured by Degussa, DBP oil absorption amount: 42 mL/100 g, pH 9.5), and 1,200 parts by mass of the unmodified polyester resin were mixed using HENSCHEL MIXER (manufactured by NIPPON COKE & ENGINEERING CO., LTD.), to obtain a mixture. The resultant mixture was kneaded at 150° C. for 30 minutes with a two-roller mill, followed by rolling and cooling, and pulverizing with a pulverizer, manufactured by Hosokawa Micron Corporation, to thereby prepare masterbatch.

The prepolymer (15 parts by mass), 85 parts by mass of the unmodified polyester resin and 130 parts by mass of ethyl acetate were charged in a beaker, followed by stirring so as to dissolve the prepolymer and the unmodified polyester resin in the ethyl acetate. Then, 10 parts by mass of carnauba wax (molecular weight: 1,800, acid value: 2.5 mgKOH/g, penetration: 1.5 mm (40° C.)), and 10 parts by mass of the masterbatch were charged into the beaker. The resultant mixture was treated with a bead mill ("ULTRA VISCOMILL," manufactured by AIMEX CO., Ltd.) under the following conditions: a liquid feed rate of 1 kg/hr, disc circumferential velocity of 6 m/s, 0.5 mm zirconia beads packed to 80% by volume, and 3 passes, to thereby prepare a starting material solution. In the starting material, 2.7 parts by mass of ketimine was dissolved, to thereby prepare a solution or dispersion of a toner material.

—Preparation of Aqueous Medium—

The non-crystalline organic fine particles and crystalline organic fine particles were diluted with 660 parts by mass of water, to thereby obtain respective regulated concentrations thereof. Twenty five parts by mass of 48.5% by mass aqueous solution of sodium dodecyldiphenyl ether disulfonate ELEMINOL MON-7 (manufactured by Sanyo Chemical Industries Ltd.) and 60 parts by mass of ethyl acetate were mixed and stirred to obtain an opaque white liquid (aqueous medium). The aqueous medium was stirred at 8,000 rpm with a TK homomixer (manufactured by Tokushu Kika Kogyo Co., Ltd.). Thereafter, with the optical microscope it was confirmed that the dispersion was performed in such a manner that the aqueous medium had no small aggregates each having a size of several micrometers. Therefore, the organic fine particles were dispersed and formed into primary particles, and adhere to liquid droplets of the toner material component in the emulsification of the toner material which was performed after the preparation of the aqueous medium.

—Preparation of Emulsion or Dispersion Liquid—

The aqueous medium (150 parts by mass) was charged in a vessel, and then stirred at 12,000 rpm with a TK homomixer (manufactured by Tokushu Kika Kogyo Co., Ltd.). Subsequently, 100 parts by mass of the solution or dispersion liquid of the toner material was added to the thus-treated aqueous medium, and the resultant mixture was mixed for 10 minutes to thereby prepare emulsion or dispersion liquid (emulsified slurry).

In some of the toner production examples, the crystalline organic fine particles were added after the emulsified slurry was formed.

—Removal of Organic Solvent—

A flask equipped with a degassing tube, a stirrer, and a thermometer was charged with 100 parts by mass of the emulsified slurry. The solvent was removed by stirring the emulsified slurry at a circumferential velocity of 20 m/min at 30° C. for 12 hours under reduced pressure, to thereby obtain a desolvated slurry. Thereafter, the dispersion liquid was heated to 60° C., to thereby fix the organic fine particles adhering to a toner surface thereon.

—Washing and Drying—

The whole amount of the desolvated slurry was filtrated under reduced pressure. Then, 300 parts by mass of ion-exchanged water was added to the filter cake, followed by mixing and redispersing with a TK homomixer at a rotation speed of 12,000 rpm for 10 min, and filtrating. Further, 300 parts by mass of ion-exchanged water was added to the filter cake, followed by mixing with a TK homomixer at a rotation speed of 12,000 rpm for 10 min and filtrating. This procedure was performed three times. The thus obtained filter cake was dried with an air circulation dryer at 45° C. for 48 hr. The dried product was sieved through a sieve with 75 μm-mesh opening, to thereby obtain toner base particles.

—External Addition Treatment—

The toner base particles (100 parts by mass) were mixed with 0.6 parts by mass of hydrophobic silica having an average particle diameter of 100 nm, 1.0 part by mass of titanium oxide having an average particle diameter of 20 nm, and 0.8 parts by mass of a fine powder of hydrophobic silica having an average particle diameter of 15 nm using a HENSCHEL MIXER to produce a toner.

The toner number and the organic fine particles, and toner properties are shown in Table 5.

In Table 5, the particle size distribution is a value of Dv/Dn. The particle size distribution was measured using a micro track particle size analyzer Model HRA9320-X100, manufactured by Honewell Co.

<Production of Carrier>

Next, a specific production example of a carrier used for a toner evaluation will be described.

The carrier used in the invention is not limited to the following example.

| -Carrier Composition- | |
|---|---|
| Acrylic resin solution (solid content: 50% by mass) | 21.0 parts by mass |
| Guanamine solution (solid content: 70% by mass) | 6.4 parts by mass |
| Alumina particles (particle diameter: 0.3 μm, specific resistance: $10^{14}$ Ω · cm) | 7.6 parts by mass |
| Silicone resin solution (solid content: 23% by mass, SR2410, manufactured by Dow Corning Toray Silicone Co., Ltd.) | 65.0 parts by mass |
| Aminosilane (solid content: 100% by mass, SH6020, manufactured by Dow Corning Toray Silicone Co., Ltd.) | 1.0 part by mass |
| Toluene | 60 parts by mass |
| Butyl cellosolve | 60 parts by mass |

The carrier composition was dispersed using a homomixer for 10 minutes to obtain a solution for forming a coating film containing an acrylic resin and a silicone resin containing alumina particles. The solution for forming a coating film was applied onto the surface of fired ferrite powder ((MgO)1.8 (MnO)49.5($Fe_2O_3$)48.0, average particle diameter: 25 μm) serving as a core material, so as to have a thickness of 0.15 μm with SPILA COATER (manufactured by OKADA SEIKO CO., LTD.), followed by drying, to thereby obtain coated ferrite powder.

The coated ferrite powder was allowed to stand in an electric furnace at 150° C. for one hour for firing. After cooling, the ferrite powder bulk was disintegrated with a sieve with an opening of 106 μm to obtain a carrier.

As to the measurement of the thickness of the coating film, since the coating film covering the surface of the carrier could

TABLE 5

| Toner No. | Non-crystalline fine particles and concentration (%) | Crystalline fine particles and concentration (%) | Toner particle diameter Dv | Particle size distribution | Toner Tg | Other conditions |
|---|---|---|---|---|---|---|
| 1 | 1A 2% | Absent | 5.2 | 1.14 | 53 | The fine particles were added before toner base particles were formed. |
| 2 | 2A 2% | Absent | 5.3 | 1.13 | 54 | The fine particles were added before toner base particles were formed. |
| 3 | 3A 2% | Absent | 5 | 1.15 | 53 | The fine particles were added before toner base particles were formed. |
| 4 | Absent | 1C 2% | 5.1 | 1.12 | 55 | The fine particles were added before toner base particles were formed. |
| 5 | Absent | 2C 2% | 5.2 | 1.14 | 56 | The fine particles were added before toner base particles were formed. |
| 6 | Absent | 3C 2% | 5.2 | 1.15 | 57 | The fine particles were added before toner base particles were formed. |
| 7 | 1A 2% | 2C 2% | 5.4 | 1.12 | 56 | The fine particles were added before toner base particles were formed. |
| 8 | 2A 2% | 2C 2% | 5.1 | 1.15 | 53 | The fine particles were added before toner base particles were formed. |
| 9 | 3A 2% | 2C 2% | 5.2 | 1.15 | 54 | The fine particles were added before toner base particles were formed. |
| 10 | 1A 2% | 1C 2% | 5.5 | 1.12 | 55 | The fine particles were added before toner base particles were formed. |
| 11 | 1A 2% | 3C 2% | 5.3 | 1.14 | 56 | The fine particles were added before toner base particles were formed. |
| 12 | 1A 2% | 4C 2% | 5.1 | 1.15 | 54 | The fine particles were added before toner base particles were formed. |
| 13 | 1A 2% | 5C 2% | 5 | 1.12 | 53 | The fine particles were added before toner base particles were formed. |
| 14 | 1A 2% | 6C 2% | 10.5 | 1.55 | 52 | The fine particles were added before toner base particles were formed. |
| 15 | 1A 2% | 7C 2% | 4.8 | 1.15 | 55 | The fine particles were added before toner base particles were formed. |
| 16 | 1A 2% | 8C 2% | 4.9 | 1.12 | 57 | The fine particles were added before toner base particles were formed. |
| 17 | 1A 2% | 9C 2% | 3.2 | 1.45 | 56 | The fine particles were added before toner base particles were formed. |
| 18 | 2A 2% | 1C 2% | 5.2 | 1.13 | 53 | The fine particles were added after toner base particles were formed. |
| 19 | 2A 2% | 2C 2% | 5.3 | 1.14 | 53 | The fine particles were added after toner base particles were formed. |
| 20 | 2A 2% | 3C 2% | 5.2 | 1.12 | 54 | The fine particles were added after toner base particles were formed. |

be observed by observing the cross-section of the carrier under a transmission electron microscope, the average value of the thickness of the coating film was determined as the thickness thereof. Thus, Carrier A having a weight average particle diameter of 35 μm was obtained.

<Production of Two-Component Developer>

A two-component developer was produced using Toners 1 to 14 and Carrier A. Specifically, 7 parts by mass of the toner and 100 parts by mass of the carrier were uniformly mixed using a tubular mixer including a container that was tumbled for stirring, and then the mixture was charged to thereby produce a two-component developer.

<Evaluation of Toner>

—Transfer Efficiency (%)—

An evaluation machine, which was a modified machine of IMAGIO MP C4500 manufactured by Ricoh Company, Ltd. and subjected to tuning so that the linear velocity and the transfer time could be adjusted, was provided. By using the evaluation machine, each developer was subjected to a running test, wherein a solid image pattern in A4 size having a toner adhesion amount of 0.6 mg/cm$^2$ was output as a test image. After outputting of 10,000 sheets of the test image and after outputting of 100,000 sheets of the test image, the transfer efficiency in the primary transfer was determined respectively by Equation (3).

$$\text{Primary transfer efficiency (\%)} = (\text{amount of toner transferred onto an intermediate transfer medium/amount of toner developed on an electrophotographic photoconductor}) \times 100 \quad \text{Equation (3)}$$

The evaluation criteria are as follows.

A: 90% or more

B: 85% or more and less than 90%

C: 80% or more and less than 85%

D: Less than 80%

—Lower Limit Fixing Temperature—

In a full-color copier IMAGIO NEOC600PRO, manufactured by Ricoh Company, Ltd. a fixing unit was modified to a fixing device, in which a temperature and a linear velocity were adjustable. Using the copier, a solid image was formed, with a toner-adhesion amount of 0.85 mg/cm$^2$±0.1 mg/cm$^2$, on plain paper and heavy paper, i.e., paper Type 6000 <70W>, manufactured by Ricoh Company, Ltd., and copy-printing paper <135>, manufactured by NBS Ricoh Co., Ltd., and then fixation was evaluated. The lower limit fixing temperature is the temperature of the fixing roller at which the residual rate of the image density of an obtained fixed image after rubbed with a pad was 70% or more.

The evaluation criteria are as follows.

A: The lower limit fixing temperature was lower than 120° C.

B: The lower limit fixing temperature was 120° C. or higher and lower than 140° C.

C: The lower limit fixing temperature was 140° C. or higher and lower than 160° C.

D: The lower limit fixing temperature was 160° C. or higher.

—Hot Offset Occurrence Temperature—

In a full color copier IMAGIO NEOC600PRO, manufactured by Ricoh Company, Ltd. a fixing unit was modified to a fixing device, in which a temperature and a linear velocity were adjustable. Using the copier, solid images of single colors of yellow, magenta, cyan, and black were formed, with a toner-adhesion amount of 0.85 mg/cm$^2$±0.3 mg/cm$^2$, on plain paper. Each of the obtained images was fixed by alternating the temperature of a heating roller, and the temperature of the fixing roll at which hot offset occurred was measured. The temperature of the fixing roll at which hot offset occurred was determined as the hot offset occurrence temperature.

The evaluation criteria are as follows.

A: The hot offset occurrence temperature was 210° C. or higher.

B: The hot offset occurrence temperature was 190° C. or higher and lower than 210° C.

C: The hot offset occurrence temperature was 170° C. or higher and lower than 190° C.

D: The hot offset occurrence temperature was lower than 170° C.

—Toner Storage Stability—

Into a 30 mL screw vial, 10 g of the obtained toner was charged, and vibration was applied to the screw vial, to thereby pack the toner into a layer. Thereafter, the toner was stored at 50° C. for 24 hours in the sealed screw vial, and then a solid state of the toner after storage was evaluated.

The evaluation criteria are as follows.

A: The entire amount of the toner in a powder form could be taken out by turning the screw vial upside down.

B: The entire amount of the toner could be taken out, but part thereof remained the shape being packed aggregate.

C: Part of the toner could be taken out, and the taken-out toner remained the shape being packed.

D: The toner was entirely solidified, and could not be taken out.

Examples 1 to 15 and Comparative Examples 1 to 5

The produced Toners 1 to 20 were evaluated according to the above description.

In Table 6, the evaluation results of Toners 1 to 20 are shown.

TABLE 6

| | Toner No. | Remarks | Primary transfer efficiency | | Fixing ability | | |
|---|---|---|---|---|---|---|---|
| | | | After outputting of 10,000 sheets | After outputting of 100,000 sheets | Lower limit fixing temperature | Hot offset occurrence temperature | Storage stability |
| Comp. Ex. 1 | 1 | Crystalline organic fine particles were absent. | C | C | D | C | D |
| Com. Ex. 2 | 2 | Crystalline organic fine particles were absent. | C | D | C | B | D |
| Comp. Ex. 3 | 3 | Crystalline organic fine particles were absent. | C | D | C | B | D |
| Comp. Ex. 4 | 17 | Crystalline organic fine particles had a high acid value. | C | D | C | C | D |
| Comp. Ex. 5 | 14 | Crystalline organic fine particles had a low acid value. | C | C | C | D | C |

TABLE 6-continued

| | Toner No. | Remarks | Primary transfer efficiency | | Fixing ability | | |
|---|---|---|---|---|---|---|---|
| | | | After outputting of 10,000 sheets | After outputting of 100,000 sheets | Lower limit fixing temperature | Hot offset occurrence temperature | Storage stability |
| Ex. 1 | 4 | | B | B | B | A | B |
| Ex. 2 | 5 | | B | B | B | B | B |
| Ex. 3 | 6 | Crystalline organic fine particles had a large particle size. | B | A | B | B | A |
| Ex. 4 | 7 | | B | B | A | A | B |
| Ex. 5 | 8 | | A | A | A | A | A |
| Ex. 6 | 9 | | A | A | A | A | A |
| Ex. 7 | 10 | | A | A | A | A | B |
| Ex. 8 | 11 | | A | A | A | A | A |
| Ex. 9 | 12 | Tg of toner and Tg of fine particles were the same. | A | B | B | A | B |
| Ex. 10 | 13 | Tg of toner was lower than Tg of fine particles. | A | B | A | B | C |
| Ex. 11 | 15 | | A | A | A | A | A |
| Ex. 12 | 16 | | A | B | B | B | A |
| Ex. 13 | 18 | Crystalline organic fine particles were added after toner base particles were formed. | A | A | A | A | B |
| Ex. 14 | 19 | Crystalline organic fine particles were added after toner base particles were formed. | A | A | A | A | A |
| Ex. 15 | 20 | Crystalline organic fine particles were added after toner base particles were formed. | A | A | A | A | A |

From Table 6, it was found that the toner containing no crystalline organic fine particle did not satisfy any of the fixing ability, the transferability, and the storage stability.

Figure 11:
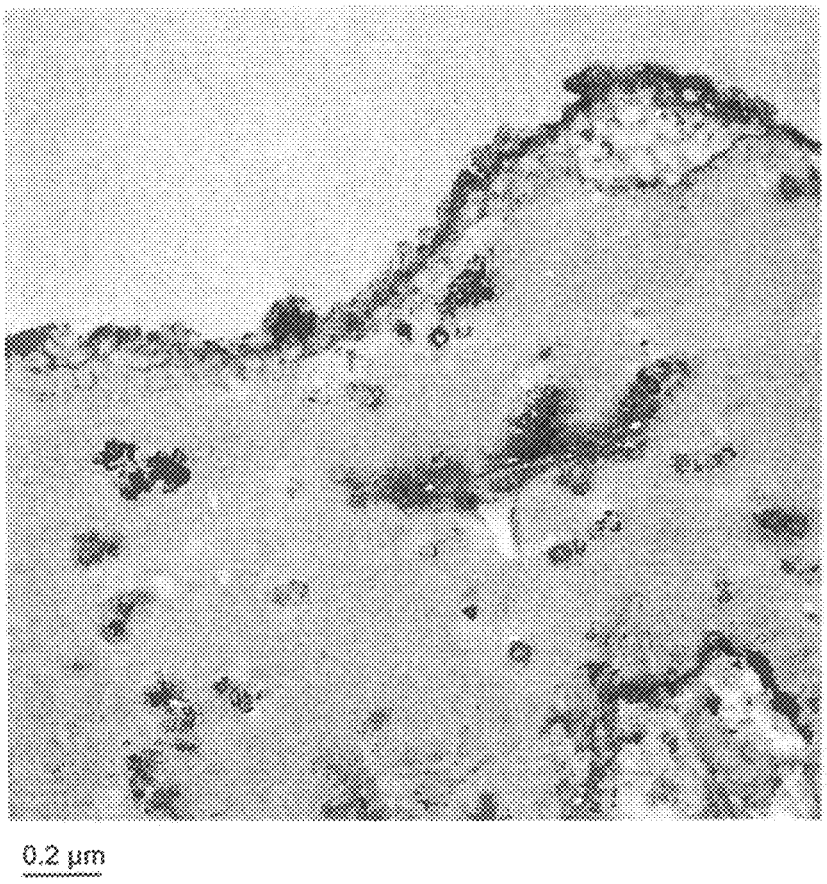
FIG. 11 is an example of a transmission electron microscope picture showing a cross section of the toner of the present invention.

FIG. 11 is an example of a transmission electron microscope picture showing a cross section of the toner of the present invention.

It was observed that all crystalline organic fine particles are arranged within 1 μm from the outermost surface of the toner base particle. Thus, the toner produced by the method for producing a toner of the present invention satisfies high quality, such as durability, fixing ability, storage stability, by arranging the crystalline organic fine particles in the toner surface.

What is claimed is:

1. A method for producing an electrophotographic toner, the toner comprising:

a toner base particle having a surface; and crystalline organic fine particles comprising a polyester resin adhering to the surface of the toner base particle;

the method comprising:

emulsifying or dispersing an organic solvent solution or dispersion of a toner material composition comprising at least a colorant, a binder resin and a binder resin precursor in an aqueous medium to obtain emulsified or dispersed oil droplets of the toner material in the aqueous medium;

adding crystalline organic fine particles having an acid value of 20 mg KOH/g to 80 mg KOH/g into the aqueous medium, before, during or after the solvent emulsification or dispersion;

removing the solvent from the emulsion or dispersion to obtain the toner base particle with the crystalline organic fine particles adhered onto the surface;

wherein a melting point of the crystalline fine particles is greater than a glass transition temperature of the toner base particle.

2. The method for producing an electrophotographic toner according to claim 1, wherein the crystalline organic fine particles are crystalline polyester resin fine particles and the polyester resin is obtained from reaction of a diacid and an aliphatic diol.

3. The method for producing an electrophotographic toner according to claim 1, wherein the polyester of the crystalline organic fine particles each comprise at least one reacted component selected from the group consisting of a fatty acid having an alkyl chain having 8 or higher carbon atoms, an aliphatic alcohol having an alkyl chain having 8 or higher carbon atoms, and esters, amides and amines thereof.

4. The method for producing an electrophotographic toner according to claim 1, wherein the crystalline organic fine particles attached to the surface of the toner base particle form a layer which is provided in a depth which is expressed by Dv×0.2, where Dv is a volume average particle diameter of the toner.

5. The method for producing an electrophotographic toner according to claim 1, further comprising:

polymerizing the binder resin precursor in the emulsion or dispersion liquid.

6. The method for producing an electrophotographic toner according to claim 1, further comprising:

dispersing the dispersion of the toner material comprising a polymerizable monomer as the binder resin precursor and the colorant in the aqueous medium;

aggregating the dispersion in the aqueous medium to form aggregates; and heating and fusing the aggregates.

7. The method for producing an electrophotographic toner according to claim 1, further comprising:

removing the organic solvent of the emulsion or dispersion liquid.

8. The method for producing an electrophotographic toner according to claim 1, wherein the binder resin precursor comprises an active hydrogen group-containing compound and a polymer reactive with the active hydrogen group-containing compound and the method further comprises:

subjecting the active hydrogen group-containing compound and the polymer reactive with the active hydrogen group-containing compound to crosslinking or elongation reaction, so as to form the emulsion or dispersion liquid; and removing the organic solvent from the emulsion or dispersion liquid.

9. The method for producing an electrophotographic toner according to claim 1, wherein an acid value of the toner base particle resin is less than the acid value of the crystalline organic fine particles.

10. The method for producing an electrophotographic toner according to claim 1, wherein a melt viscosity of the crystalline fine particles is less than a melt viscosity of the toner base particle.

11. The method for producing an electrophotographic toner according to claim 1, wherein a hydroxyl value of the polyester resin of the crystalline fine particles is higher than the resin of the toner base particle.

12. The method for producing an electrophotographic toner according to claim 1, wherein the binder resin precursor comprises an active hydrogen group-containing compound and a modified polyester resin reactive with the active hydrogen compound.

* * * * *